US009261328B2

(12) United States Patent
Sitz

(10) Patent No.: US 9,261,328 B2
(45) Date of Patent: Feb. 16, 2016

(54) UNIVERSAL HOLDER FOR A FIREARM

(71) Applicant: Justin Sitz, Bryan, TX (US)

(72) Inventor: Justin Sitz, Bryan, TX (US)

( * ) Notice: Subject to any disclaimer, the term of this patent is extended or adjusted under 35 U.S.C. 154(b) by 163 days.

(21) Appl. No.: 13/987,603

(22) Filed: Aug. 12, 2013

(65) Prior Publication Data

US 2013/0327799 A1 Dec. 12, 2013

Related U.S. Application Data

(63) Continuation-in-part of application No. 13/066,269, filed on Apr. 11, 2011.

(51) Int. Cl.
*F41C 33/02* (2006.01)
*F41A 23/18* (2006.01)

(52) U.S. Cl.
CPC ..... *F41C 33/0245* (2013.01); *F41A 23/18* (2013.01)

(58) Field of Classification Search
CPC ..... F41C 33/0245; F41C 33/0236; F41C 33/0254; F41C 33/048; F41C 33/04
USPC ..... 224/243, 255, 268, 666, 247, 248, 904
See application file for complete search history.

(56) References Cited

U.S. PATENT DOCUMENTS

| | | | | |
|---|---|---|---|---|
| 1,166,781 | A | 1/1916 | Parrish | |
| 1,768,177 | A * | 6/1930 | Wanee | 224/674 |
| 2,401,174 | A | 5/1946 | McAuley | |
| 2,758,762 | A | 8/1956 | Medley | |
| 2,764,326 | A | 9/1956 | Stanton | |
| 2,765,107 | A | 10/1956 | B.W. Browning | |
| 2,951,622 | A | 9/1960 | Heim | |
| 3,353,728 | A | 11/1967 | Freed | |
| 3,642,184 | A * | 2/1972 | Hendricks | 224/666 |
| 3,796,358 | A * | 3/1974 | Grubb | 224/255 |
| 3,938,717 | A | 2/1976 | Theodore | |
| 4,022,361 | A | 5/1977 | Devlin | |
| 4,120,109 | A | 10/1978 | Musgrave | |
| 4,442,962 | A | 4/1984 | Musgrave | |
| 4,483,089 | A | 11/1984 | Johnson | |
| 4,580,363 | A | 4/1986 | Rowe, Jr. | |
| 4,597,213 | A | 7/1986 | Musgrave | |
| 4,667,374 | A | 5/1987 | Bianchi | |
| 4,928,876 | A | 5/1990 | Marshall | |

(Continued)

OTHER PUBLICATIONS

Young, Lee W., "Patent Cooperation Treaty International Search Report and Written Opinion dated Jun. 15, 2012", PCT Application No. PCT/US12/00153, Patent Cooperation Treaty, Jun. 15, 2012.

(Continued)

*Primary Examiner* — Adam Waggenspack
(74) *Attorney, Agent, or Firm* — Lindauer Law, PLLC

(57) ABSTRACT

Holders usable to secure a firearm include a first plate, a second plate extending from the first plate at a first angle, and an insertable member extending from the second plate at a second angle. The insertable member is adapted for insertion into the barrel of the firearm to stabilize the firearm against lateral movement. Friction between the firearm and the first plate, a trigger guard engaged with the holder, or combinations thereof can stabilize the firearm against vertical movement. Such friction can be created using application of a lateral force against the interior of the firearm barrel using the insertable member, application of a lateral force against the exterior of the firearm using a trigger guard, use of a protruding, compressible, or frictional surface on the first plate, or combinations thereof.

27 Claims, 13 Drawing Sheets

(56) References Cited

U.S. PATENT DOCUMENTS

| | | | | | |
|---|---|---|---|---|---|
| 5,081,709 | A | * | 1/1992 | Benyo et al. | 455/348 |
| 5,129,562 | A | * | 7/1992 | Bianchi | F41C 33/0227 224/244 |
| 5,167,355 | A | | 12/1992 | Hill | |
| 5,322,297 | A | | 6/1994 | Smith | |
| 5,358,160 | A | | 10/1994 | Bianchi | |
| 5,472,317 | A | * | 12/1995 | Field et al. | 417/234 |
| 5,584,423 | A | * | 12/1996 | Wang | 224/197 |
| 5,611,471 | A | * | 3/1997 | French | F41C 33/008 224/243 |
| 5,622,297 | A | | 4/1997 | Rogers et al. | |
| 5,624,064 | A | * | 4/1997 | McGee, Jr. | 224/414 |
| 5,749,507 | A | * | 5/1998 | Wood | 224/587 |
| 5,806,739 | A | | 9/1998 | Wood | |
| 5,810,222 | A | * | 9/1998 | Shoemaker | F41C 33/0227 224/192 |
| 5,855,305 | A | * | 1/1999 | Nichols | 224/244 |
| 6,003,207 | A | * | 12/1999 | Homma | 24/3.12 |
| 6,398,089 | B1 | | 6/2002 | Har-Shen | |
| 6,668,479 | B1 | | 12/2003 | Obong | |
| 6,829,855 | B2 | | 12/2004 | Seifert | |
| 7,314,152 | B1 | | 1/2008 | Garrett | |
| 8,006,424 | B1 | | 8/2011 | Ligard | |
| 8,533,876 | B2 | * | 9/2013 | Bonk | 5/503.1 |
| 2009/0229292 | A1 | | 9/2009 | Sweeney | |
| 2009/0321480 | A1 | | 12/2009 | Kincaid et al. | |
| 2010/0264177 | A1 | * | 10/2010 | Clifton, Jr. | 224/269 |
| 2012/0260554 | A1 | | 10/2012 | Huffines | |

OTHER PUBLICATIONS

Waggenspack, "Final Office Action dated May 21, 2013", U.S. Appl. No. 13/066,269, The United States Patent and Trademark Office, May 21, 2013.

Waggenspack, "Non Final Office Action dated Jan. 4, 2013", U.S. Appl. No. 13/066,269, The United States Patent and Trademark Office, Jan. 4, 2013.

Waggenspack, Adam J., "Notice of Allowance dated Jul. 8, 2015", U.S. Appl. No. 13/900,242, The United States Patent and Trademark Office, Jul. 8, 2015.

Waggenspack, Adam J., "Final Office Action dated May 6, 2015", U.S. Appl. No. 13/066,269, The United States Patent and Trademark Office, May 6, 2015.

Waggenspack, Adam J., "Non-Final Office Action dated Dec. 5, 2014", U.S. Appl. No. 13/066,269, The United States Patent and Trademark Office, Dec. 5, 2014.

Waggenspack, Adam J., "Non-Final Office Action dated Jan. 27, 2015", U.S. Appl. No. 13/900,242, The United States Patent and Trademark Office, Jan. 27, 2015.

Waggenspack, Adam J., "Advisory Action, dated Aug. 21, 2015", U.S. Appl. No. 13/066,269, The United States Patent and Trademark Office, Aug. 21, 2015.

Waggenspack, Adam J., "Non-final Office Action dated Aug. 14, 2015", U.S. Appl. No. 14/134,955, The United States Patent and Trademark Office, Aug. 14, 2015.

* cited by examiner

UNIVERSAL HOLDER FOR A FIREARM

CROSS-REFERENCE TO RELATED APPLICATIONS

The present application is a continuation-in-part application, which claims priority to the co-pending United States application for patent having the application Ser. No. 13/066,269, filed Apr. 11, 2011, which is incorporated by reference herein in its entirety.

FIELD

Embodiments of the present disclosure relate, generally, to holders (e.g., holsters) for firearms, and related methods, and more specifically, to holders for pistols, handguns, and/or other types of firearms that can utilize a member for insertion into a barrel of a firearm, and/or friction between the firearm and the holder, to stabilize the firearm.

BRIEF DESCRIPTION OF THE DRAWINGS

In the detailed description of various embodiments usable within the scope of the present disclosure, presented below, reference is made to the accompanying drawings, in which.

Figure 2B:
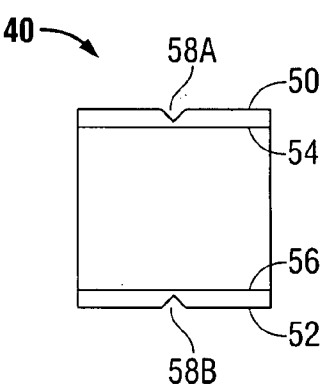
FIG. 2B depicts a diagrammatic front view of the spacing insert of FIG. 2A.

One or more embodiments are described below with reference to the listed Figures.

DETAILED DESCRIPTION OF THE EMBODIMENTS

Before describing selected embodiments of the present invention in detail, it is to be understood that the present invention is not limited to the particular embodiments described herein. The disclosure and description herein is illustrative and explanatory of one or more presently preferred embodiments of the invention and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood the drawings are intended illustrate and plainly disclose presently preferred embodiments of the invention to one of skill in the art, but are not intended to be manufacturing level drawings or renditions of final products and may include simplified conceptual views as desired for easier and quicker understanding or explanation of the invention. As well, the relative size and arrangement of the components may differ from that shown and still operate within the spirit of the invention as described throughout the present application.

Moreover, it will be understood that various directions such as "upper", "lower", "bottom", "top", "left", "right", and so forth are made only with respect to explanation in conjunction with the drawings, and that the components may be oriented differently, for instance, during transportation and manufacturing as well as operation. Because many varying and different embodiments may be made within the scope of the inventive concept(s) herein taught, and because many modifications may be made in the embodiments described herein, it is to be understood that the details herein are to be interpreted as illustrative and non-limiting.

Embodiments usable within the scope of the present disclosure relate to holders (e.g., holsters) for securing firearms (e.g., pistols and/or handguns) when worn or carried by a user and/or for securing firearms to a surface, such as the underside of a table or counter, the interior of a vehicle, the side of a bed, or other types of surfaces. While conventional holsters are sized and designed specifically to contain a single firearm, can vary in size and shape depending on the numerous external features and customizations unique to every gun, and are often only able to be acquired weeks or months after acquiring a firearm, embodiments of the present invention can be usable as a "universal" holster, able to secure multiple firearms, in a variety of orientations. As such, embodiments of the present firearm holder can be worn ambidextrously, on either side of a user's body, can selectively be worn internal of or external to a user's belt and/or pants or other lower body garment, and provide a minimum of bulk, thereby creating only a minimal profile or picture, facilitating concealment of a weapon. Conversely, it is often difficult to acquire a left-handed or ambidextrous conventional holster, and conventional holsters are typically bulky due to the structure necessary to secure a firearm.

Conventional holsters typically restrain a firearm in a holstered and/or unused position using physical barriers, such as straps or similar portions of a holster body that prevent removal of the firearm from a holster by impeding the path thereof, gravity, or a combination of these elements. As described above, use of physical barriers is reliant on the unique exterior features of each firearm, as each holster must be designed with a shape and orientation and/or configuration of parts capable of retaining the specific firearm for which it is designed. Additionally, such physical structure adds bulk, weight, and cost to a holster, and increases the time required to manufacture the holster, while also providing the holster with a larger profile, hindering the ability to conceal the holster and associated firearm. In many conventional holsters, gravity, alone, is often insufficient for safely securing a firearm within a holster, as the firearm may become inadvertently removed from the holster if the wearer changes orientations (such as when rolling, climbing, running, falling, etc.), or if the holster or article of clothing to which it is attached changes positions.

Embodiments usable within the scope of present disclosure include holders usable to secure a firearm using a member for insertion into a barrel of a firearm, friction between the firearm and one or multiple parts of the holder, or combinations thereof, to stabilize the firearm, thereby minimizing bulk, enabling the firearm to be secured and/or carried in a variety of orientations, and enabling a single holder to be used with any number of firearms having the same or similar caliber, independent of the exterior features thereof. For example, a holder having an insertable member (e.g., a pin, rod, cylinder, etc.) sized for passage within the barrel of a semi-automatic pistol (e.g., a 9 mm ACP, Luger, etc.) would also be usable with a revolver having a similarly-sized barrel, enabling a single holder to be used with many of the most commonly carried firearms. In a similar manner, a holder could be provided with an insertable member having any desired dimensions, for accommodating any number of firearms having the same or similar caliber. In an embodiment, a single holder could be provided with a removable and/or replaceable insertable member, an adjustable insertable member, and/or an insertable member having a tapered shape for accommodating firearm barrels of various sizes. However, it should be understood that even a holder having a single insertable member of a fixed diameter can be used with a potentially large number of firearms, e.g., any firearm having a barrel diameter equal or close to that of the diameter of the insertable member.

Figure 1A:
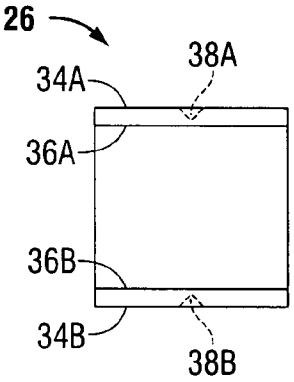
FIG. 1A depicts a diagrammatic front detail view of the area labeled as "A" in FIG. 1.
Figure 1:
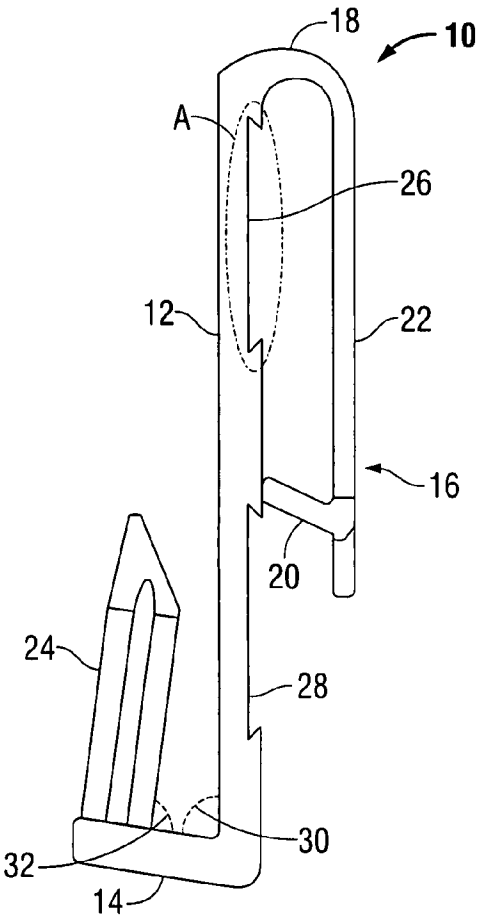
FIG. 1 depicts a diagrammatic side view of an embodiment of a holder for a firearm, usable within the scope of the present disclosure.

Referring now to FIG. 1, a side view of an embodiment of a holder (10) for a firearm, usable within the scope of the present disclosure, is shown. The depicted holder (10) includes a first, generally vertical plate (12), having upper and lower ends, and a second, generally horizontal plate (14) extending from the lower end of the first plate (12) at a first angle (30). In the depicted embodiment, the first angle (30) is acute (e.g., less than 90 degrees). A clip (16) extends from the upper end of the first plate (12), the depicted clip (16) having an upper curved portion (18), a rear straight portion (22), and a lower crimped portion (20), such that in use, a belt, waistband, strap, or similar article of clothing or other object can be contained within the space defined between the clip portions (18, 20, 22) and the first plate (12). It should be understood that the depicted clip (16) is of an exemplary configuration, and that any type of clip or other fastener could be used to secure the embodied holder (10) to an article of clothing or other object without departing from the scope of the present disclosure. Further, it should be understood that while FIG. 1 depicts a holder in which the first, generally vertical plate (12) and the second, generally horizontal plate (14) are a unitary structure, in various embodiments, the plates (12, 14) could be separated, attachable parts, movably (e.g., pivotably) attached to one another to enable adjustment, and/or spring biased toward one another to facilitate frictional engagement of a firearm.

An insertable member (24), depicted as a generally cylindrical pin or rod, having an angled and/or tapered tip, is shown extending from the second plate (14) at a second angle (32). In the depicted embodiment, the second angle (32) is shown as a generally perpendicular (e.g., 90-degree) angle. In use, a firearm can be secured to the depicted holder (10) by inserting the insertable member (24) into the barrel thereof. In an embodiment, one or more portions of the body of the holder (10) and/or the insertable member (24) can be formed from a material having sufficient flexibility (e.g., plastic, rubber, one or more polymers, certain metals, etc.) to allow the holder (10) and/or insertable member (24) to be bent and/or repositioned slightly to accommodate insertion of the insertable member (24) into a firearm barrel (e.g., by repositioning the insertable member (24) such that it is generally parallel to the longitudinal axis of the firearm barrel to enable insertion therein unimpeded by the first plate (12)). Due to the first angle (30) being an acute angle, the insertable member (24) extends toward the first plate (12), such that a firearm engaged thereon is urged against the first plate (12) (e.g., the firearm is "clamped" between the insertable member (24) and the first plate (12)), creating friction between the firearm and the holder (10). Contact between the insertable member (24) and the interior of the barrel of the firearm can prevent undesired lateral movement of the firearm, while friction between the firearm and the holder (10) can prevent undesired vertical movement thereof, such as upward movement that could disengage the firearm from the holder (10). The friction between the firearm and the holder (10) can be sufficient such that a user pulling upward on a firearm engaged with the holder (10) could selectively overcome the frictional force retaining the firearm in engagement with the holder (10) to draw the firearm, or remove the clip (16) from a belt or similar article of clothing while the holder (10) and firearm remain engaged, depending on the manner in which the user pulls on the firearm (e.g., whether the user manipulates the clip to disengage the clip from a belt or similar object). In an embodiment, the holder could be at least partially formed from a slightly flexible material (e.g., plastic, rubber, one or more polymers, etc.) to facilitate bending thereof, to further enable a user to affect the contact and friction between the firearm and holder while pulling upward.

While FIG. 1 depicts the first angle (30) as an acute angle and the second angle (32) as a generally perpendicular angle, it should be understood that the depicted configuration is exemplary, and any combination of angles that causes the insertable member (24) and/or second plate (14) to urge an engaged firearm against the first plate (12), or vice versa, can be used without departing from the scope of the present disclosure. For example, in some embodiments, use of acute angles may be unnecessary, such as embodiments where friction between a firearm and a holder is created through other means, which could include, without limitation, a protruding tension member, molding, or other feature of the holder that contacts an engaged firearm, and/or through a trigger guard or other element that frictionally grips a firearm or contacts and urges an engaged firearm against a portion of the holder (e.g., any part of the insertable member, first plate, or second plate.)

FIG. 1 depicts the embodied holder (10) having two spaces (26, 28) formed on the rear side of the first plate (12), the spaces (26, 28) being adapted to accommodate the insertion and retention of optional accessories. The depicted spaces (26, 28) are shown having a dovetail profile, though any manner of space, having any shape or dimensions, able to accommodate a complementary insertable component can be used without departing from the scope of the present disclosure. In an embodiment, the spaces (26, 28) can be adapted for generally non-removable retention of spacing inserts or a trigger guard insert.

For example, FIG. 1A depicts a front detail view of the first space (26), having a generally square or rectangular shape, bounded by an upper outer edge (34A) and a lower outer edge (34B). The overhang created by the depicted dovetail profile provides the space (26) with an upper inner edge (36A) and a lower inner edge (36B), providing the space (26) with a generally trapezoidal cross-sectional shape when viewed from the side. A first protrusion (38A) is shown extending from the upper outer edge (34A) (e.g., beneath the overhang created by the upper inner edge (36A)), while a second protrusion (38B) is shown extending from the lower outer edge (34B) (e.g., beneath the overhang created by the lower inner edge (36B)). The protrusions (38A, 38B) are usable to engage complementary recessions formed within insertable components adapted for insertion into the space (26); however, it should be understood that while FIG. 1A depicts the space (26) including two protrusions (38A, 38B), in other embodiments, the space (26) could include recessions adapted for engagement with complementary protrusions in other objects, or any combination of protrusions and recessions adapted for engagement with members having complementary features. In other embodiments, use of protrusions and/or recessions could be omitted, and insertable components could be force fit into the space (26), adhesively secured therein, secured using one or more fasteners, or other similar means, without departing from the scope of the present disclosure.

Figure 2A:
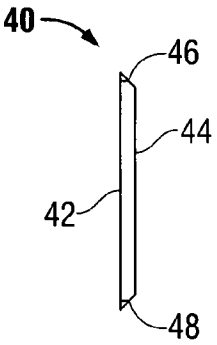
FIG. 2A depicts a diagrammatic side view of an embodiment of a spacing insert usable in conjunction with the holder of FIG. 1.

Referring now to FIGS. 2A and 2B, side and front views, respectively, of an embodiment of a spacing insert (40) adapted for insertion into the spaces (26, 28, shown in FIGS. 1 and 1A) of the holder of FIG. 1 are shown. The depicted spacing insert (40) is shown having a generally trapezoidal cross-sectional shape (e.g., complementary to that of the spaces in the holder), defined by a front face (44), a rear face (42), an upper angled face (46), and a lower angled face (48). The intersection of the upper angled face (46) with the rear face (42) defines the upper outer edge (50) of the insert (40), while the intersection of the lower angled face (48) with the rear face (42) defines the lower outer edge (52) thereof. The intersection of the upper angled face (46) with the front face (44) provides the insert (40) with an upper inner edge (54), while the intersection of the lower angled face (48) with the front face (44) provides the insert (40) with a lower inner edge (56). FIG. 2B depicts the insert (40) having a first recession (58A) formed in the upper outer edge (50) and a second recession (58B) formed in the lower outer edge (52). In use, the depicted spacing insert (40) can be inserted (e.g., longitudinally) into one of the spaces (e.g., spaces (26, 28), shown in FIG. 1), such that the protrusions thereof (e.g., protrusions (38A, 38B), shown in FIG. 1A) engage the recessions (58A, 58B) in the insert (40). Spacing inserts can thereby be retained in the spaces provided in a holder to provide strength thereto, e.g., when it is not desired to attach a trigger guard or similar accessory to the holder using the spaces (26, 28) as a point of attachment.

Figure 3:
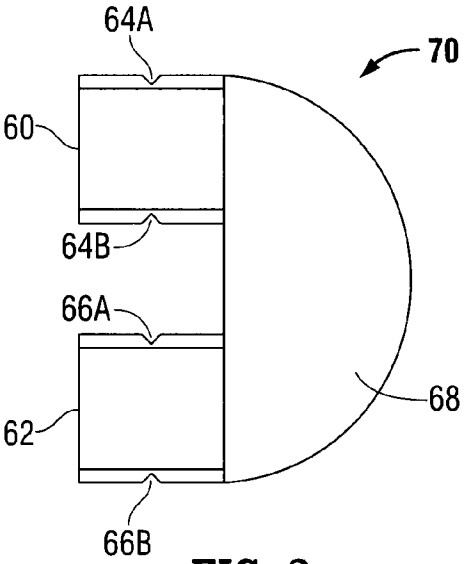
FIG. 3 depicts a diagrammatic front view of an embodiment of a trigger guard insert usable in conjunction with the holder of FIG. 1.

Referring now to FIG. 3, a front view of an embodiment of a trigger guard insert (70), adapted for insertion into the spaces (26, 28, shown in FIGS. 1 and 1A) of the holder of FIG. 1 is shown. The depicted trigger guard insert (70) includes a first insertion portion (60) adapted for insertion into the first space (26, shown in FIG. 1) of the holder of FIG. 1, and a second insertion portion (62) adapted for insertion into the second space (28, shown in FIG. 1). The depicted insertion portions (60, 62) are substantially identical to the spacing insert shown in FIG. 2, being sized and shaped for insertion into the spaces of the holder of FIG. 1 in generally the same manner. For example, the first insertion portion (60) is shown having a first recession (64A) adapted to engage the first protrusion (38A, shown in FIG. 1A) of the first space (26, shown in FIG. 1), and a second recession (64B) adapted to engage the second protrusion (38B, shown in FIG. 1A). The second insertion portion (62) is shown having recessions (66A, 66B) for engagement with complementary protrusions within the second space (28, shown in FIG. 1), which, in an embodiment, can be substantially identical to the first space. It should be understood, however, that the holder shown in FIG. 1 could be provided with any number of identical or dissimilar spaces, and that any manner of trigger guard insert, spacing inserts, or other types of accessories could be provided with insertion portions capable of engaging one or more of the spaces of the holder, without departing from the scope of the present disclosure.

FIG. 3 depicts the trigger guard insert (70) having a trigger guard body (68) extending from one side of the insertion portions (60, 62), the trigger guard body (68) having a generally semicircular shape adapted to extend adjacent to the trigger of a firearm when engaged with the holder of FIG. 1. Because the depicted embodiment includes insertion portions (60, 62) and spaces (26, 28, shown in FIG. 1) that are substantially identical, the trigger guard insert (70) could be selectively engaged with the holder from either side of the spaces, such that the trigger guard body (68) extends outward from a selected side of the holder, depending on how a user intends to carry the holder and an engaged firearm (e.g., whether the user is left-handed or right-handed).

Figure 4B:
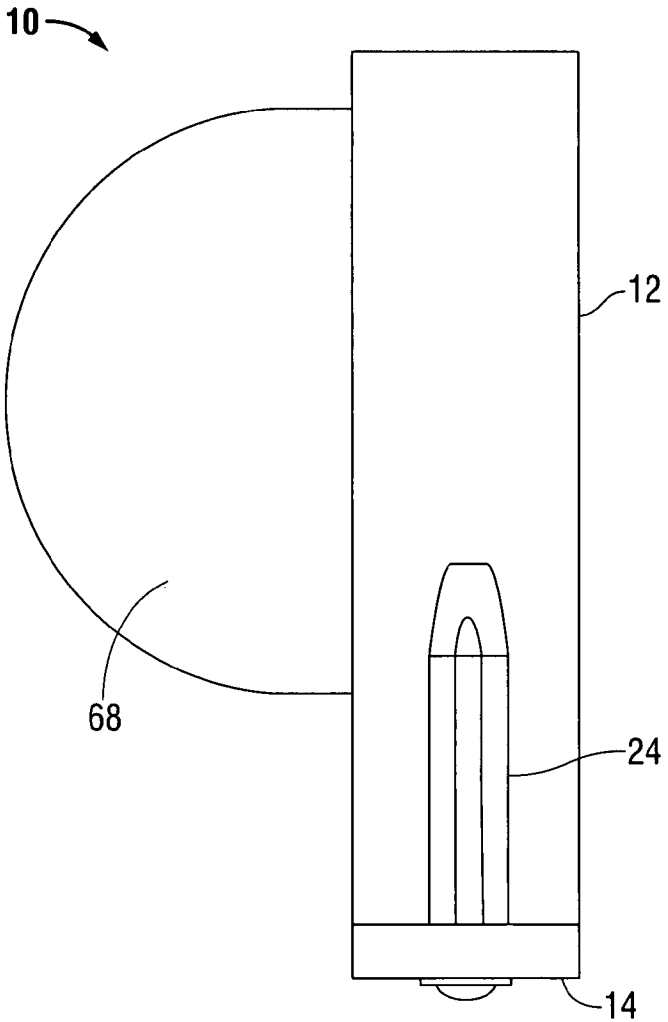
FIG. 4B depicts the holder of FIG. 1 engaged with the trigger guard insert of FIG. 3 in a second configuration.
Figure 4A:
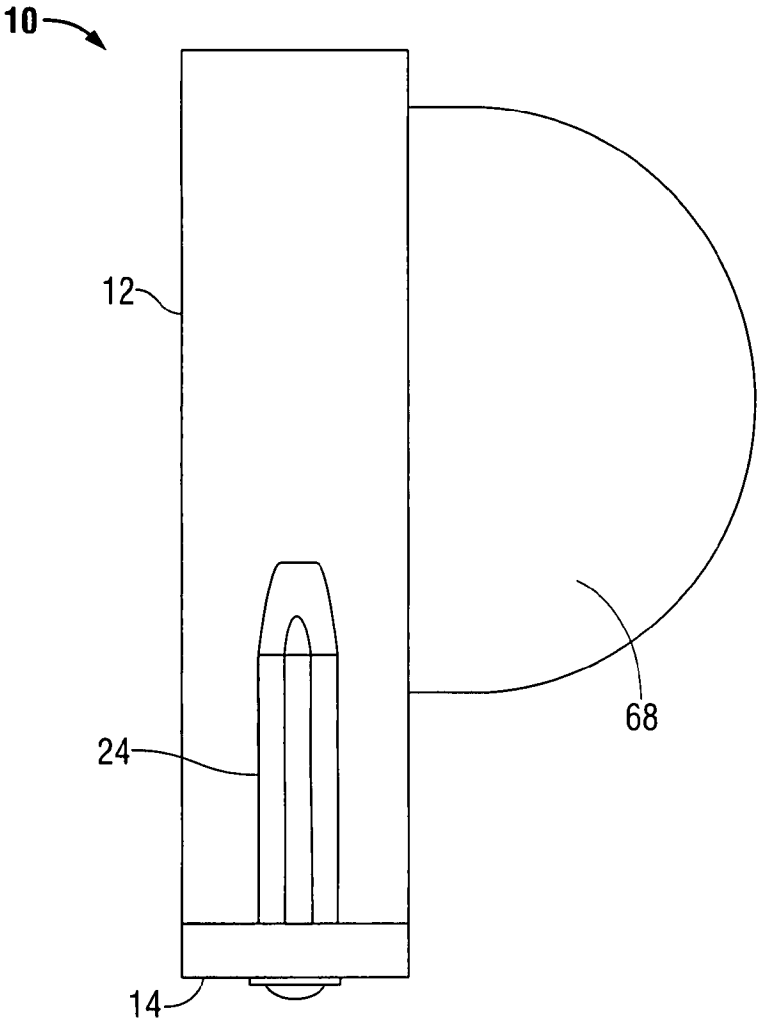
FIG. 4A depicts a front view of the holder of FIG. 1 engaged with the trigger guard insert of FIG. 3 in a first configuration.

For example, FIG. 4A depicts a front view of the holder (10) of FIG. 1, having the first plate (12), second plate (14), and insertable member (24), as described above, in which the trigger guard insert of FIG. 3 has been engaged therewith, e.g., through insertion of insertion portions of the trigger guard insert within spaces in the holder, as described above. As such, the trigger guard body (68) extends outward from the right side of the first plate (12), such that a firearm can be engaged with the holder (10) (e.g., through insertion of the insertable member (24) into the barrel thereof) and positioned such that the trigger guard body (68) overlaps and is adjacent to the trigger thereof.

FIG. 4B depicts a front view of the holder (10), having the first plate (12), second plate (14) and insertable member (24), as described above, in which the trigger guard insert of FIG. 3 has been engaged therewith in an alternate configuration. As described above, because the holder of FIG. 1 and the trigger guard insert of FIG. 3 are shown having generally identical spaces and insertion portions, respectively, either of the insertion portions of the trigger guard insert could be inserted into either of the spaces of the holder. As such, FIG. 4B depicts an embodiment in which the trigger guard insert of FIG. 3 has been inverted and inserted into the opposite side of the holder (10) than that depicted in FIG. 4A. Thus, the depicted trigger guard body (68) extends outward from the left side of the holder (10), such that a firearm can be engaged with the holder (10) (e.g., through insertion of the insertable member (24) into the barrel thereof) and positioned with an orientation opposite that of a firearm engaged with the holder of FIG. 4A, such that the trigger guard body (68) overlaps and is adjacent to the trigger thereof.

As such, FIGS. 1 through 4B depict a system by which a holder can be selectively provided with a trigger guard having a right-handed configuration, a trigger guard having a left-handed configuration, or spacing inserts in lieu of a trigger guard. It should be understood that other types of attachments could be provided without departing from the scope of the present disclosure, and in other embodiments, use of spaces in the holder body and/or attachments could be wholly omitted. In still other embodiments, a holder could be provided with an integral trigger guard and/or a trigger guard attached to the holder through other means (e.g., use of adhesives and/or fasteners to engage one or more portions of the holder body).

Figure 5A:
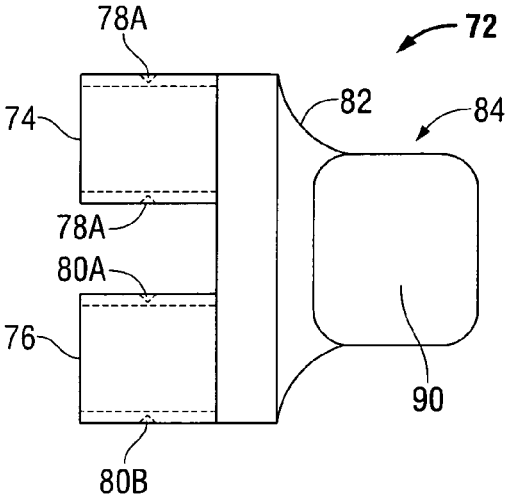
FIG. 5A depicts a diagrammatic front view of an alternate embodiment of a trigger guard insert usable in conjunction with the holder of FIG. 1.
Figure 5B:
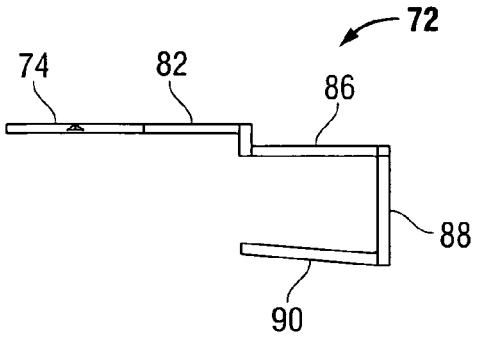
FIG. 5B depicts a diagrammatic side view of the trigger guard insert of FIG. 5A.
Figure 5C:
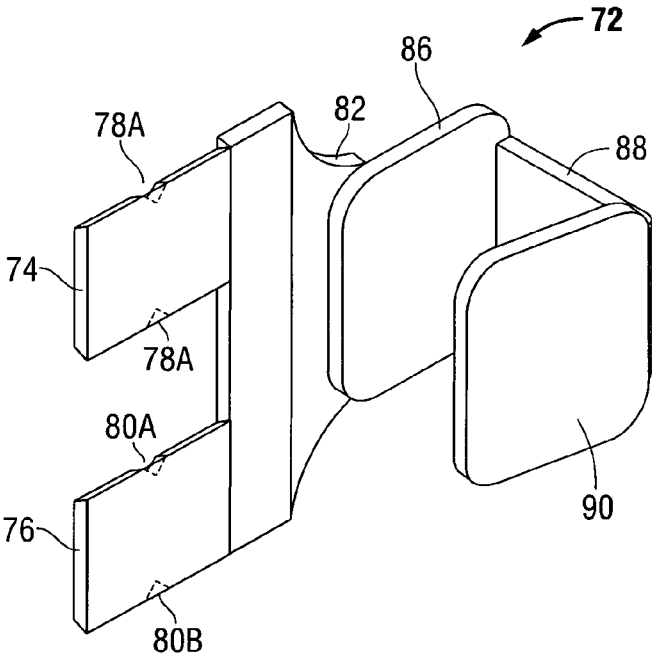
FIG. 5C depicts a perspective view of the trigger guard insert of FIG. 5A.

Referring now to FIGS. 5A, 5B, and 5C, a front view, side view, and perspective view, respectively, of an alternate embodiment of a trigger guard insert (72) are shown, usable in conjunction with the holder of FIG. 1 and/or other holders usable within the scope of the present disclosure. The depicted trigger guard insert (72) is adapted to overlap and/or cover both sides of a trigger of a firearm that is engaged with the holder. As such, the insert (72) is shown having a first insertion portion (74) having recessions (78A, 78B) for engagement with complementary protrusions within a space (e.g., the space (26), shown in FIG. 1) in the holder sized to accommodate the insertion portion (74), as described above. Similarly, a second insertion portion (76) is shown having recessions (80A, 80B) for engagement with complementary protrusions within an additional space (e.g., the space (28), shown in FIG. 1) in the holder.

The insert (72) is further shown having a tapered portion (82) extending between the insertion portions (74, 76) and a trigger cover portion (84), adapted to overlap and/or cover both sides of a trigger of an engaged firearm. The trigger cover portion (84) is shown having a rear face (86), a connecting face (88), and a front face (90). In use, a firearm engaged with the holder of FIG. 1 (e.g., through insertion of the insertable member into the barrel thereof) can be oriented such that the trigger thereof is positioned within the trigger cover portion (84), e.g., between the front and rear faces (86, 90). As described above with reference to the trigger guard insert shown in FIG. 3, the depicted trigger guard insert (72) can be selectively engaged with a holder in a right-handed manner or a left-handed manner (e.g., positioned such that the trigger cover portion (84) extends outward from the right or left side of the holder body), depending on the manner in which a user intends to carry the holder and firearm. In an embodiment, a portion of the trigger guard insert (72) (e.g., the trigger cover portion (84)) can be configured to frictionally contact and/or engage a firearm. For example, the front and rear faces (86, 90) could be spaced from each other a distance that requires a trigger area of a firearm to be force fit between the faces (86, 90), such that the trigger cover portion (84) itself frictionally retains a firearm in engagement therewith. Alternatively or additionally, the trigger cover portion (84) could be shaped to contact the firearm in another manner that generates friction between the firearm and the trigger cover portion (84). Further, in various embodiments, the trigger guard insert (72) could be formed from a generally flexible material (e.g., plastic) and positioned in a manner such that engagement of the trigger portion of a firearm within the trigger cover portion (84) causes the trigger guard insert (72) to apply a force against the firearm, urging the firearm against a portion of the holder to create friction therebetween. For example, a trigger cover portion could be oriented to urge a firearm against the vertical and/or horizontal plates of a holder (e.g., the holder shown in FIG. 1), or alternatively, the trigger cover portion could be oriented to urge the firearm in a direction perpendicular to both plates, such that the urging force applied by the trigger cover portion presses the firearm against the insertable member of the holder, increasing frictional contact between the insertable member and the firearm. As such, in various embodiments, a trigger guard could be used to frictionally engage a firearm and/or to cause friction between a firearm and any portion of a holder, in addition to or in lieu of the configuration of components described above with reference to FIG. 1. For example, a holder lacking any acute angles between members, or a portion of the holder body that would contact a firearm when the barrel thereof is positioned over an insertable member of the holder, could frictionally retain a firearm through use of a trigger guard that frictionally grips the firearm, and/or a trigger guard that urges the firearm against a portion of the body to create friction between the firearm and holder. As such, an embodiment usable within the scope of the present disclosure could include a holder that creates friction against an engaged firearm at up to four locations: 1) an insertable member could extend at an angle toward the body of the holder to urge the engaged firearm against the holder body to create friction; 2) a compressible member, such as molding, on the holder body could apply a resilient biasing force against the engaged firearm, urging it against the insertable member to create friction; 3) a trigger guard member having multiple faces could frictionally grip a portion of the firearm between the faces; and 4) the trigger guard member could apply a biasing force against a firearm, urging the firearm against the holder body and/or the insertable member, creating friction.

Figure 6A:
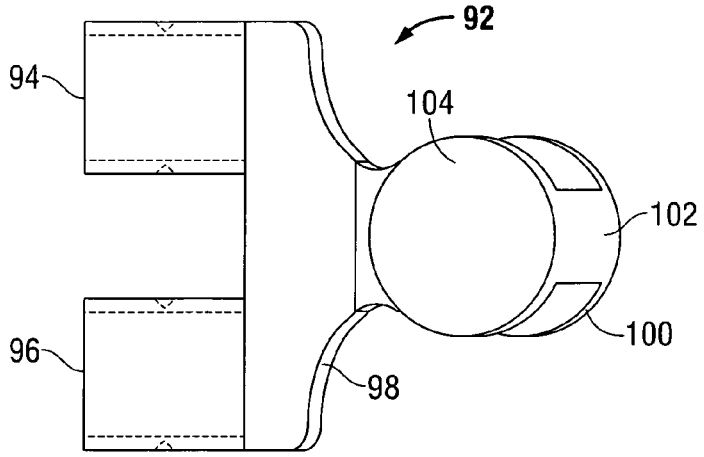
FIG. 6A depicts a front view of an alternate embodiment of a trigger guard insert usable in conjunction with the holder of FIG. 1.
Figure 6B:
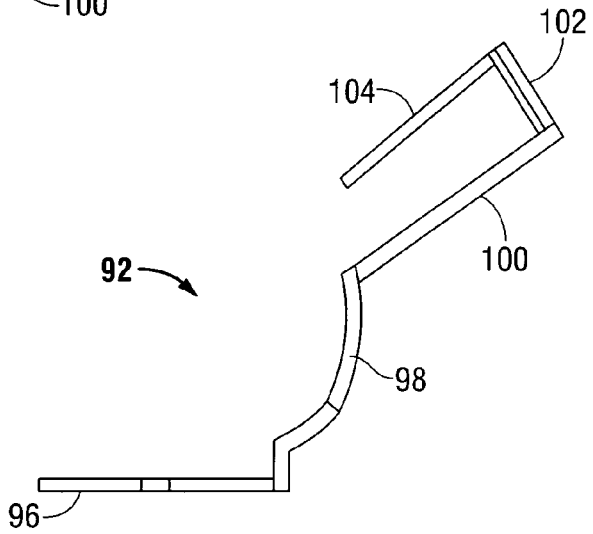
FIG. 6B depicts a side view of the trigger guard insert of FIG. 6A.
Figure 6C:
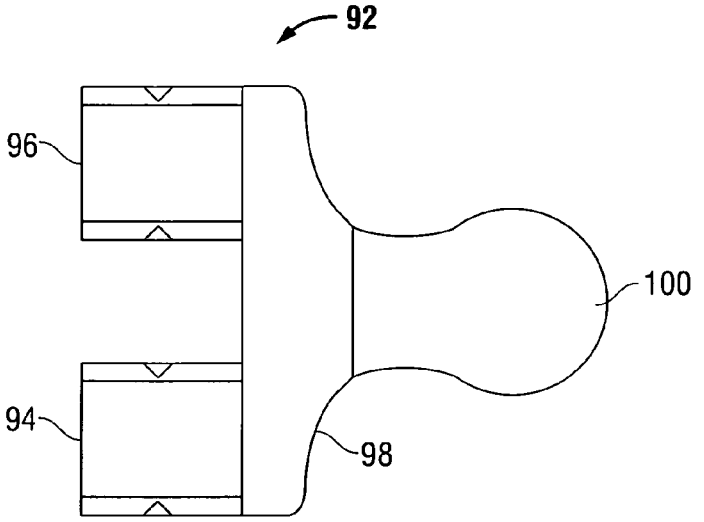
FIG. 6C depicts a rear view of the trigger guard insert of FIG. 6A.

Referring now to FIGS. 6A, 6B, and 6C, a front view, side view, and rear view, respectively, of an alternate embodiment of a trigger guard insert (92) are shown, usable in conjunction with the holder of FIG. 1 and/or other holders usable within the scope of the present disclosure. The depicted trigger guard insert (92) is adapted for use with a revolver, and as such, includes body portions positioned to cover both sides of the trigger region of a revolver when the revolver is engaged with a holder (e.g., through insertion of an insertable member thereof into the revolver barrel). Similar to the trigger guard insert shown in FIGS. 5A through 5C, the depicted trigger guard insert (92) is adapted to overlap and/or cover both sides of a trigger of a firearm that is engaged with the holder.

The insert (92) is shown having a first insertion portion (94) and a second insertion portion (96), which are adapted for engagement within spaces (e.g., the spaces (26, 28) shown in the holder of FIG. 1) in a holder, such as through the interlocking of protrusions within recessions or similar means of retention, as described above. A curved portion (98) extends between the insertion portions (94, 96) and the trigger-cover portion of the insert (92). The curved portion (98) is shaped and/or angled such that the trigger-cover portion can be positioned adjacent to the trigger portion of a revolver when the revolver is engaged with a holder (e.g., through insertion of an insertable member into the barrel thereof). The trigger-cover portion is shown including a rear face (100), a front face (104), and a connecting face (102) extending between the front and rear faces (100, 104). In use, a firearm engaged with, e.g., the holder of FIG. 1 (e.g., through insertion of the insertable member into the barrel thereof) can be oriented such that the trigger thereof is positioned between the front and rear faces (100, 104). As described above with reference to the trigger guard inserts show in FIG. 3 and FIGS. 5A through 5C, the depicted trigger guard insert (92) can be selectively engaged with a holder in a right-handed manner or a left-handed manner (e.g., positioned such that the trigger cover portion extends outward from the right or left side of the holder body), depending on the manner in which a user intends to carry the holder and firearm. As described above with reference to the trigger guard insert shown in FIGS. 5A through 5C, in various embodiments, the depicted trigger guard insert (92) can be configured to frictionally contact and/or engage a firearm, e.g., by contacting the engaged firearm in a manner that creates friction between the firearm and the trigger guard insert (92) and/or by urging the firearm against a portion of the associated holder to create friction between the firearm and holder.

Figure 7A:
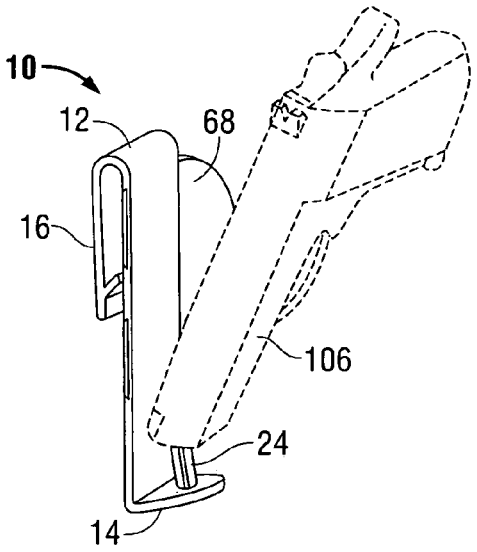
FIG. 7A depicts a first step of an embodiment of a method for using the holder shown in FIG. 1.

Referring now to FIGS. 7A through 7D, an embodiment of a method by which the holder (10); shown in FIG. 1, which is shown engaged with the trigger guard insert of FIG. 3, can be engaged with a firearm and carried by a user is shown. FIG. 7A depicts a holder (10), having a first plate (12) (e.g., a generally vertical plate), a second plate (14) (e.g., a generally horizontal plate) extending from the lower end of the first plate (12) at an acute angle, and an insertable member (24) (e.g., a rod and/or pin) extending from the second plate (14). A clip (16) for engaging the holder (10) with an article of clothing or other object is shown extending from the upper end of the first plate (12). The trigger guard body (68) is shown extending from one side of the holder (10).

A firearm (106) is shown being moved into engagement with the holder (10). FIG. 7A depicts the firearm (106) positioned at an initial angle relative to the insertable member (24) and/or first plate (12) of approximately 45 degrees. As described previously, one or more portions of the holder (10) can be formed form an at least partially flexible material (e.g., plastic) to enable the insertable member (24) to be positioned in a manner that facilitates insertion thereof into the barrel of the firearm (106), unimpeded by the first plate (12) or other portions of the holder (10), e.g., by bending and/or deflecting the insertable member (24) outward from the first plate (12) until the insertable member (24) is generally parallel to the axis of the barrel of the firearm (106). The tapered end of the insertable member (24) can facilitate insertion of the insertable member (24) into the firearm barrel and guide the insertable member (24) toward the center of the barrel, e.g., by accommodating for a small degree of inaccuracy when inserting the insertable member (24), such that contact between the front end of a firearm and a tapered portion of the insertable member (24) aligns the barrel of the firearm with the insertable member (24).

Figure 7B:
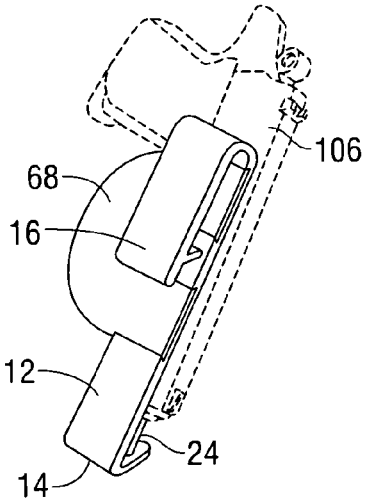
FIG. 7B depicts a second step of an embodiment of the method shown in FIG. 7A.

FIG. 7B depicts a second step of the method for using the depicted holder, in which the insertable member (24) is shown partially inserted into the barrel of the firearm (106). After the initial insertion of the insertable member (24), as shown in FIG. 7A, the firearm (106) can be positioned generally parallel to the insertable member (24) and/or the first plate (12).

Figure 7C:
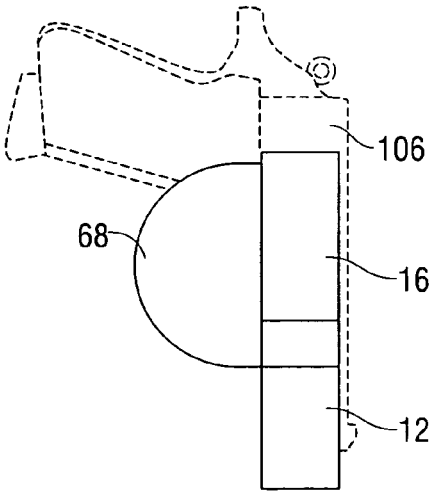
FIG. 7C depicts a third step of an embodiment of the method shown in FIGS. 7A and 7B.

FIG. 7C depicts a third step of the method for using the depicted holder, in which the insertable member (not visible in FIG. 7C) has been fully inserted into the barrel of the firearm (106), e.g., by pushing the firearm (106) downward along the axis of the insertable member and/or first plate (12). The firearm (106) is shown being oriented in a right-handed manner, such that the trigger portion thereof is adjacent to and covered by the trigger guard body (68). Once engaged with the holder, friction is created between the firearm (106) and the first plate (12) (e.g., due to the acute angle between the first and second plates (12, 14) urging the firearm against the first plate (12) by contact between the insertable member (24) and the interior of the firearm barrel).

Figure 7D:
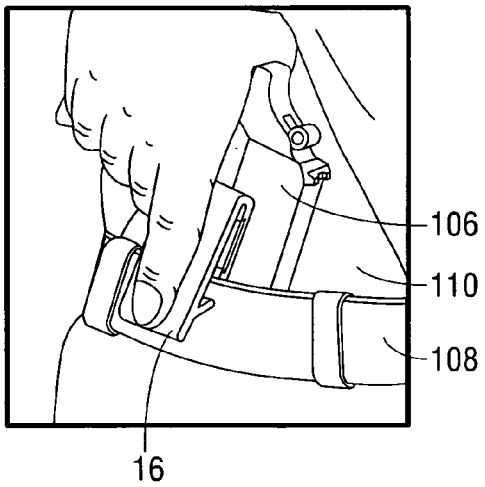
FIG. 7D depicts a fourth step of an embodiment of the method shown in FIGS. 7A, 7B, and 7C.
Figure 8A:
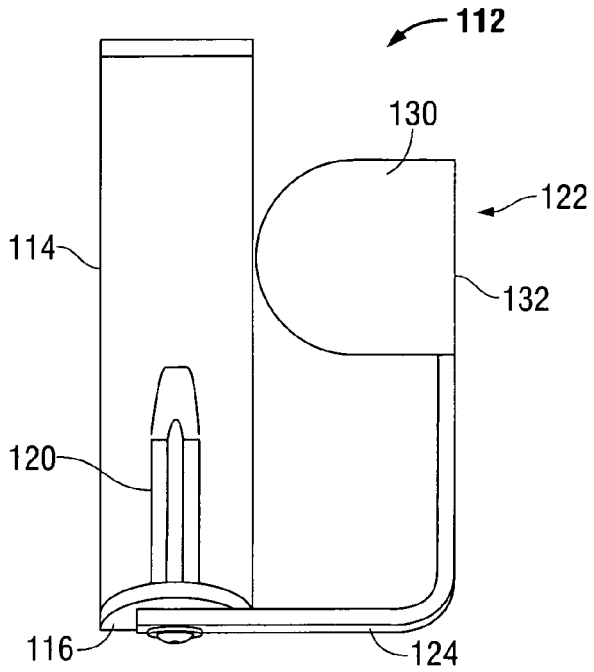
FIG. 8A depicts a front view of an embodiment of a holder usable within the scope of the present disclosure, having a movable trigger guard engaged therewith.
Figure 8B:
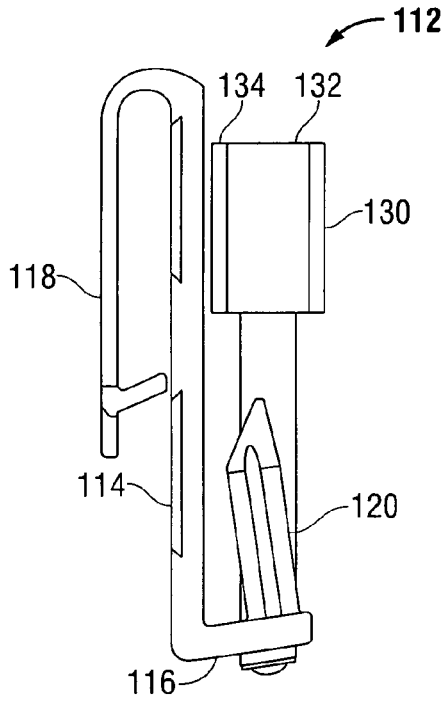
FIG. 8B depicts a side view of the holder of FIG. 8A.
Figure 8C:
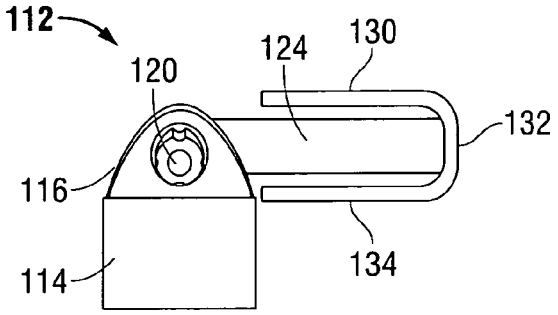
FIG. 8C depicts a top view of the holder of FIG. 8A.
Figure 8D:
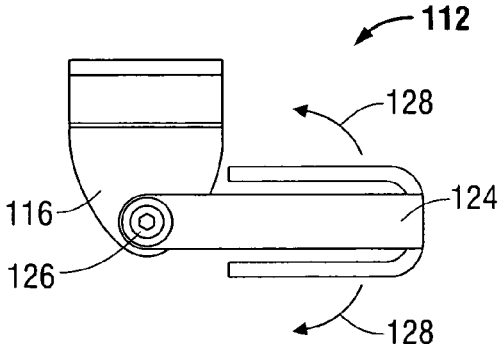
FIG. 8D depicts a bottom view of the holder of FIG. 8A.

FIG. 7D depicts a forth step of the method for using the depicted holder, in which the clip (16) thereof is engaged with a belt (108) of a user (110), such that the firearm (106) can be retained inside and/or underneath a user's clothing. As described previously, the friction between the firearm (106) and holder can be sufficient such that an upward force applied to the firearm (106) by the user can selectively disengage the firearm from the holder while the holder remains engaged with the belt (108), or remove the holder from the belt while the firearm (106) and holder remain engaged.

While FIGS. 7A through 7D depict an embodiment of a holder (10) having an acute angle between first and second plates (12, 14), such that the insertable member (24) extends toward the first plate (12) to generate friction between the firearm (106) and holder (10), it should be understood that in various embodiments, friction could be generated between the firearm (106) and holder (10) through other means, such that the presence of acute angles or other configurations of components that generate friction in this manner is not necessary. For example, in an embodiment, the holder (10) could be at least partially formed from a material having sufficient flexibility such that engagement of the holder to a user's belt and/or contact between the user's clothing and/or body and the holder can slightly deform or bend the holder, and/or otherwise increase contact between the holder and firearm, thereby creating friction between the holder and firearm that retains the firearm in engagement with the holder, independent of the configuration of the portions of the holder.

Referring now to FIGS. 8A, 8B, 8C, and 8D, a front view, side view, top view, and bottom view, respectively, of an embodiment of a holder (112), having a movable trigger guard (122) attached therewith, usable within the scope of the present disclosure, is shown. The depicted holder (112) includes a first plate (114) (e.g., a generally vertical plate) having upper and lower ends. A second plate (116) (e.g., a generally horizontal plate) is shown extending from the lower end of the first plate (114) at an acute angle, while a clip (118) extends from the upper end of the first plate (114) for securing the holder (112) to an article of clothing of a user, or another object. An insertable member (120), shown as a pin and/or rod having a cylindrical body and a tapered tip, extends upward from the second plate (116). Due to the acute angle between the first and second plates (114, 116), the insertable member (120) extends toward the first plate (114), such that a firearm engaged thereon can be biased and/or urged against the first plate (114) to create friction between the firearm and the holder (112). However, it should be understood that in various embodiments, use of acute angles may be omitted, and that friction between a firearm and the holder (112) and/or between a firearm and the trigger guard (122) could be achieved using other methods, as described above and below.

The trigger guard (122) is shown attached to the holder (112) via a rotatable/pivotable pin connection (126) at the lower end thereof. Specifically, the trigger guard (122) is depicted having a movable and/or flexible arm (124), having an angled and/or curved shape, extending between the pin connection (126) and a trigger cover portion of the trigger guard (122), such that the trigger cover portion is positioned outward from (e.g., to the side of) the holder (112). Specifically, the arm (124) and attached trigger cover portion can be rotated and/or pivoted, as indicated by the arrows (128), shown in FIG. 8D, to selectively position the depicted trigger guard (122) on either side of the holder (112) (e.g., in a left or right-handed configuration), as well as any position therebetween, outward from the front side of the holder (112), or outward from the back side of the holder (112). As such, the trigger guard can be selectively positioned to overlap and/or cover the trigger portion of a firearm that is engaged with the holder (112) in either a left-handed or right-handed orientation, and can further be positioned outward a selected distance from the first plate (114), e.g., to accommodate the position of the trigger portion of a revolver or a similar type of firearm, and/or to enable a firearm of any type to be positioned at any angle and/or rotational position relative to the holder (112).

Specifically, the trigger guard (122) is shown having a first face (130) opposite a second face (134), with a connecting face (132) therebetween, providing the depicted cover portion of the trigger guard (122) with a U-shaped cross-section. In use, the trigger guard (122) can be positioned such that when a firearm is engaged with the holder (112), e.g., by positioning the insertable member (120) within the barrel thereof, the trigger portion of the firearm can be positioned between the first and second faces (130, 134). In an embodiment, the faces (130, 132, 134) and/or the arm (124) can contact and frictionally engage a firearm to retain the firearm in engagement with the holder (112). Additionally or alternatively, the trigger guard (122) can urge and/or bias a firearm against the body of the holder (112), e.g., by positioning the trigger guard (122) such that when a firearm is engaged therewith, the arm (124) is flexed and/or pivoted outward, and the tendency of the arm (124) to return to its original position biases the firearm against the first plate (114), the insertable member (120), and/or one or more other portions of the holder (112), depending on the position of the trigger guard (122).

Figure 9A:
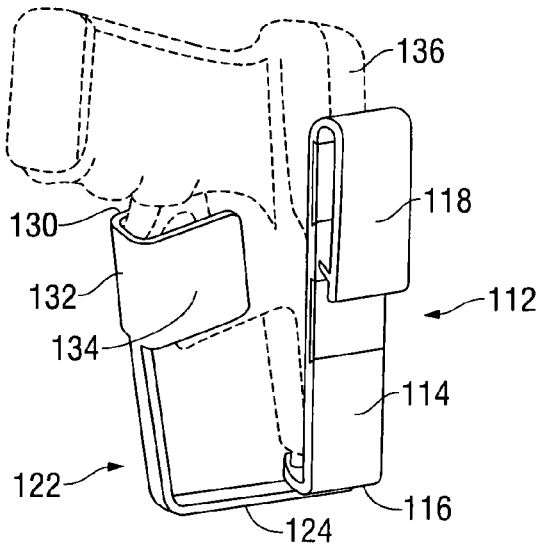
FIG. 9A depicts a side perspective view of a firearm engaged with the holder shown in FIGS. 8A through 8D in a first configuration.
Figure 9B:
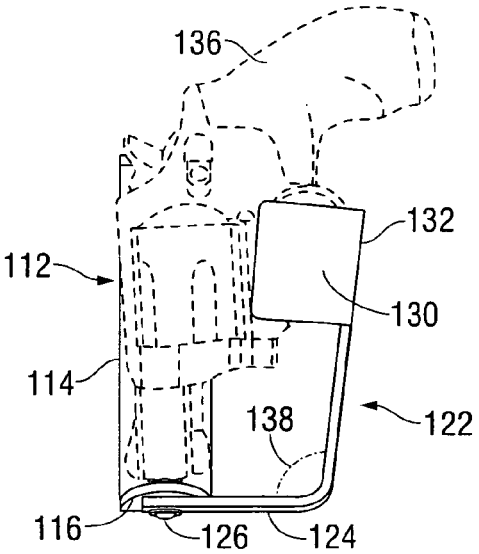
FIG. 9B depicts a side perspective view of a firearm engaged with the holder shown in FIGS. 8A through 8D in a second configuration.
Figure 9C:
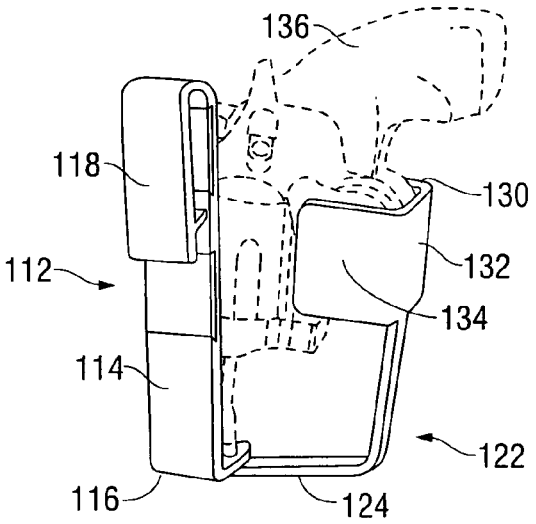
FIG. 9C depicts a side perspective view of a firearm engaged with the holder shown in FIGS. 8A through 8D in a third configuration.
Figure 9D:
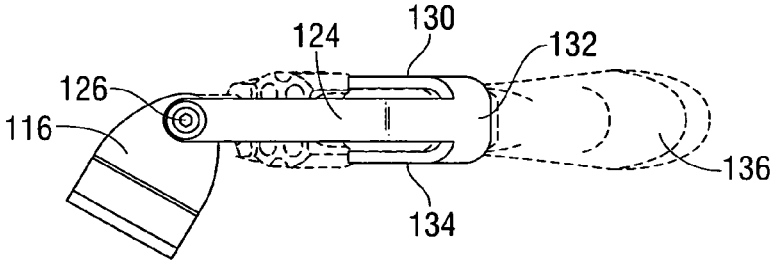
FIG. 9D depicts a bottom view of the firearm and holder of FIG. 9C.

Referring now to FIGS. 9A through 9D, the holder (112) shown in FIGS. 8A through 8D is depicted in various configurations (e.g., having the trigger guard (122) thereof positioned in various orientations relative to the body of the holder (112)), engaged with a firearm (136). Specifically, FIG. 9A depicts the firearm (136) as a nine millimeter pistol, while FIGS. 9B through 9D depict the firearm (136) as a revolver, though it should be understood that the depicted holder (112) could be used with any type of firearm without departing from the scope of the present disclosure. As such, FIGS. 9A through 9D illustrate an embodiment of a holder (112) and associated trigger guard (122) that could be selectively used with both revolvers and semi-automatic pistols, simply through and adjustment of the position of the trigger guard (122), as described below.

FIG. 9A depicts the holder (112) having a first plate (114) having a second plate (116) and a clip (118) extending therefrom, as described previously. The depicted firearm (136) can be engaged with the holder (112) by inserting the insertable member thereof (120, shown in FIGS. 8A through 8C) into the barrel of the firearm (136). As described above, in various embodiments, the relative angles between the plates (114, 116) and/or the insertable member can bias the firearm (136) against the first plate (114) and/or another portion of the holder (112) to create friction therebetween for securing the firearm (136) against undesired movement relative to the holder (112). The trigger guard (122) is shown having the arm (124) thereof positioned generally perpendicular to the body of the holder (112) (e.g., extending outward from a side thereof), such that the faces (130, 132, 134) encircle the trigger portion of the firearm (136). While FIG. 9A depicts the trigger guard (122) positioned on a first side of the holder (112), it should be understood that the trigger guard (122) could be rotated and/or pivoted to accommodate orientation of the firearm (136) in the opposing direction (e.g., a left-handed configuration), and/or any position therebetween. As described previously, in various embodiments, the trigger guard (122) could be configured to frictionally contact and/or grip the firearm (136), such that use of acute angles between the insertable member and the first plate, and/or other features to create friction between the body of the holder (112) and the firearm (136), can be omitted. In other embodiments, the trigger guard (122) could apply a force against the firearm (136) in the direction of the holder (112) to create friction between the holder (112) and firearm (136). For example, when the trigger guard (122) is positioned as depicted in FIG. 9A (e.g., generally perpendicular to the plates (114, 116) of the holder (112)), the arm (124) can apply a generally lateral and/or perpendicular biasing force to the firearm (136), such that the interior of the barrel is urged into frictional contact with the insertable member (120). Alternatively, the trigger guard (122) could be positioned in a manner that urges the firearm (136) against the first plate (114) to create friction therebetween.

FIG. 9B depicts the holder (112) engaged with a revolver-type firearm (136), while the trigger guard (122) is positioned at an angle (e.g., approximately 45 degrees) relative to the holder (112); specifically, the arm (124) of the trigger guard (122) is shown extending outward from the front of the first plate (114), and toward one side of the holder (112), such that the faces (130, 132, 134) encircle the trigger portion of the firearm (136). As described above, while the trigger guard (122) could be configured to frictionally contact and/or grip the firearm (136), in the depicted embodiment, contact between the firearm (136) and the trigger guard (122) can cause the arm (124) to be bent outward relative to the holder (112), at an angle (138), such that the tendency of the arm (124) to return to its original shape can apply a force against the firearm (136). Because at least a partial component of this force is applied in the direction of the holder (112), the arm (124) can urge the firearm (136) into frictional contact with the first plate (114) and/or another portion of the holder (112), such that friction between the firearm (136) and holder (112) resists unintentional movement of the firearm (136) relative to the holder (112). The force applied by the trigger guard (122) can also create and/or increase friction between the firearm (136) and the insertable member (120), as described previously.

FIG. 9C depicts the holder (112) engaged with a revolver-type firearm (136), with the trigger guard (122) positioned at an angle opposite that of the angle shown in FIG. 9B. As such, FIG. 9C illustrates the movability of the trigger guard (122), showing that the depicted revolver-type firearm (136) can be selectively carried in a left-handed or right-handed orientation. FIG. 9D depicts a bottom view of the holder (112) and firearm (136) shown in FIG. 9C. Similar to the configuration shown in FIG. 9B, the trigger guard (122) is shown extending outward from the front of the first plate (114), and toward one side of the holder (112), such that the faces (130, 132, 134) encircle the trigger portion of the firearm (136). In the depicted embodiment, contact between the firearm (136) and the trigger guard (122) causes the arm (124) to be bent outward relative to the holder (112), such that the tendency of the arm (124) to return to its original shape can apply a force against the firearm (136). Because at least a partial component of this force is applied in the direction of the holder (112), the arm (124) can urge the firearm (136) into frictional contact with the first plate (114) and/or another portion of the holder (112), such that friction between the firearm (136) and holder (112) resists unintentional movement of the firearm (136) relative to the holder (112).

Figure 10A:
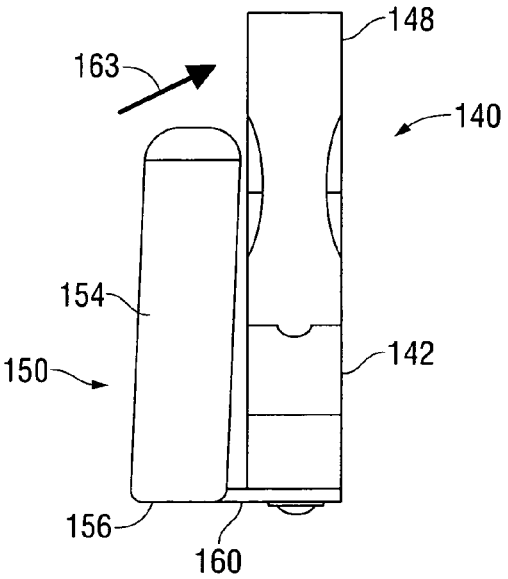
FIG. 10A depicts a rear view of an embodiment of a holder usable within the scope of the present disclosure, having a trigger guard engaged therewith.
Figure 10B:
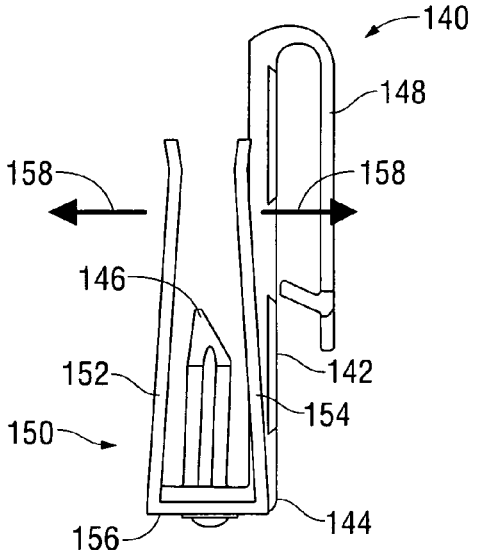
FIG. 10B depicts a side view of the holder of FIG. 10A.
Figure 10C:
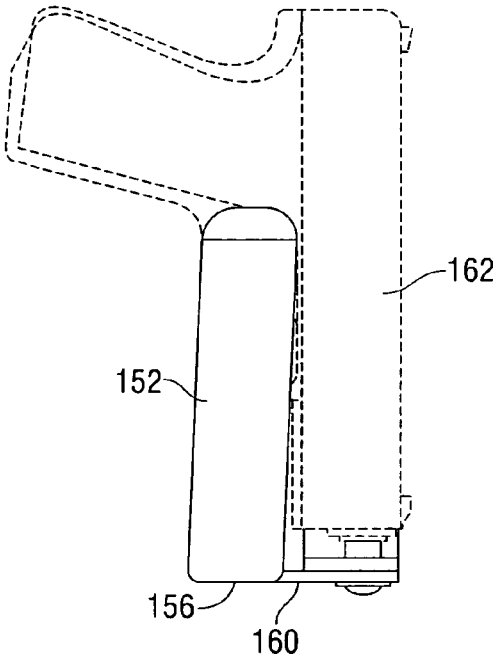
FIG. 10C depicts a front view of the holder of FIG. 10A, engaged with a firearm.
Figure 10D:
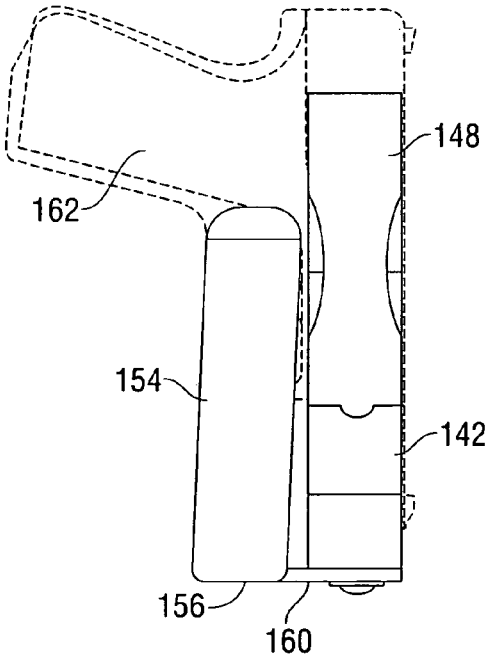
FIG. 10D depicts a rear view of the holder of FIG. 10A, engaged with a firearm.
Figure 10E:
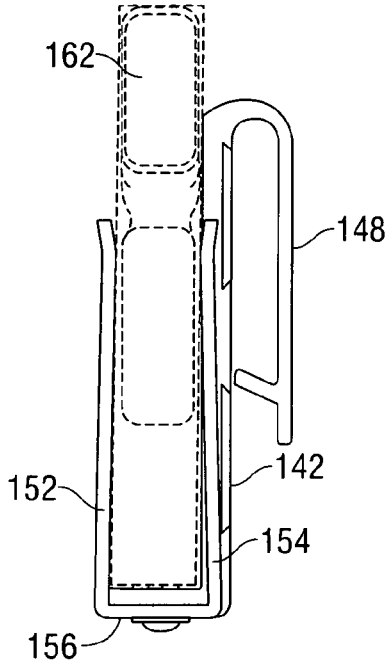
FIG. 10E depicts a side view of the holder of FIG. 10A, engaged with a firearm.

Referring now to FIGS. 10A through 10E, an embodiment of a holder (140) having a trigger guard (150) engaged therewith, usable within the scope of the present disclosure, is shown. Specifically FIGS. 10A and 10B depict rear and side views of the holder (140), respectively, while FIGS. 10C, 10D, and 10E depict front, rear, and side views of the holder (140) engaged with a firearm (162), respectively.

The holder (140) is shown having a first plate (142) (e.g., a generally vertical plate), with a second plate (144) (e.g., a generally horizontal plate) extending therefrom at one end, and a clip (148) extending from the opposing end. An insertable member (146), shown as a pin and/or rod having a tapered end, extends from the second plate (144). The depicted holder (140) is further shown having a trigger guard (150) associated therewith, which can be attached, e.g., using a movable, rotatable, and/or pivotable connection, similar to that shown in FIGS. 8A through 8D, and/or using a fixed connection. In other embodiments, the trigger guard (150) could be integral with any portion of the holder (140). The trigger guard (150) is shown having a generally elongate, U-shaped cross-section, that includes a first face (152) opposite a second face (154), and connected thereto via a connecting face (156) that in turn engages and/or extends from the second plate (144). For example, FIG. 10A depicts a connecting arm (160) extending between the second plate (144) and the connecting face (156) of the trigger guard (150), to provide a desired spacing between the trigger guard (150) and the holder (140). In an embodiment, the connecting arm (160) and/or one or more portions of the holder (140) or trigger guard (150) can be formed from a generally flexible material, such that when a firearm is engaged with the holder (140) (e.g., by inserting the insertable member (146) into the barrel thereof), contact between the firearm and the trigger guard (150) can cause the trigger guard (150), connecting arm (160), and/or holder (140) to bend and/or flex, such that the tendency of the guard (150), arm (160), and/or holder (140) to return to its original shape can apply a force to the firearm, thereby generating friction between the firearm and the guard (150), arm (160), and/or holder (140).

In use, when a firearm is engaged with the holder (140) (e.g., by inserting the insertable member (146) into the barrel thereof), the firearm can be oriented such that the trigger portion thereof is positioned between the first and second faces (152, 154) of the trigger guard (150). In an embodiment, the first and second faces (152, 154) can be spaced such that placement of the firearm therebetween may contact one or both faces (152, 154) (e.g., via a force-fit of friction fit between the faces (152, 154)). For example, FIG. 10B depicts the first and second faces (152, 154) having a generally close spacing, such that insertion of a firearm therebetween can urge the faces in an outward direction, as indicated by the arrows (158). The tendency of the trigger guard (150) to return to its original shape would then cause the faces (152, 154) to frictionally grip and/or clamp the firearm, thereby preventing unintended movement of the firearm relative to the holder (140). FIG. 10A depicts an embodiment in which the connecting arm (160) and/or trigger guard (150) is at least slightly flexible, such that engagement of a firearm with the holder (140) and trigger guard (150) can bias the trigger guard (150) outward (e.g., by bending the connecting arm (160)). The tendency of the arm (160) and/or trigger guard (150) to return to its original shape can apply a force against an engaged firearm (e.g., in the direction indicated by arrow (162), thereby urging the firearm against one or more portions of the holder (140) to create friction therebetween.

FIG. 10C depicts a front view of the holder (140), having a firearm (162) engaged therewith. FIG. 10D depicts a rear view of the holder (140), having the firearm (162) engaged therewith. FIG. 10E depicts a side view of the holder (140), having the firearm engaged therewith. As depicted in FIGS. 10C through 10E, the firearm (162) can be engaged with the holder (140), such as through insertion of the insertable member (146, shown in FIG. 10A) into the barrel thereof, such that the front of the firearm is adjacent to the second plate (144). When the firearm (162) is engaged with the holder (140), the firearm (162) can be oriented such that the trigger portion thereof is positioned between the first and second faces (152, 154) of the trigger guard. As described previously, in an embodiment, the faces (152, 154) can contact and/or frictionally grip the firearm (162) to limit undesired movement thereof. Alternatively or additionally, the trigger guard can impart a force to the firearm (162), urging the firearm (162) against the holder (140) to create friction therebetween.

Figure 11A:
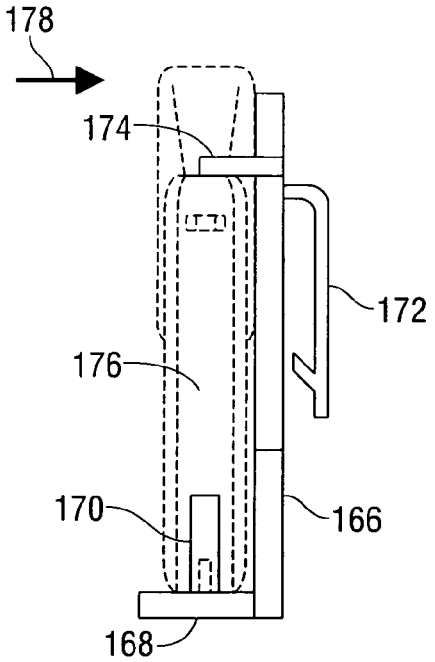
FIG. 11A depicts a diagrammatic side view of an embodiment of a holder for a firearm, usable within the scope of the present disclosure, having a latch or similar barrier associated therewith.
Figure 11B:
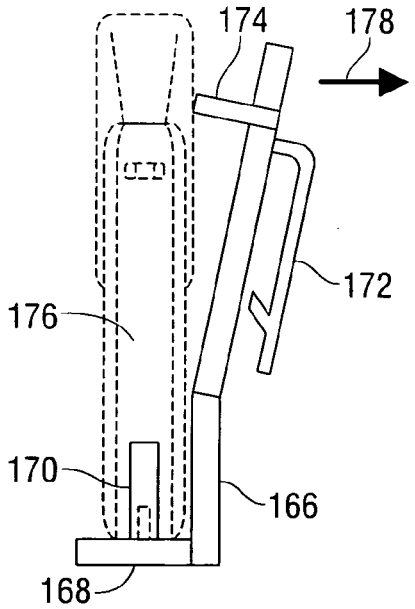
FIG. 11B depicts a diagrammatic side view of the holder of FIG. 11A in an open position.

As described previously, in various embodiments, the creation of friction between a firearm and the holder, e.g., through use of acute angles between portions of the holder body, may not be necessary. For example, FIGS. 11A and 11B depict a diagrammatic side view of an embodiment of a holder engaged with a firearm (176). The depicted holder includes a first plate (166) (e.g., a generally vertical plate), engaged with a second plate (168) (e.g., a generally horizontal plate), and an insertable member (170) (e.g., a rod and/or pin) extending from the second plate (168). In the depicted embodiment, the first and second plates (166, 168) are generally perpendicular to one another, while the insertable member (170) is generally perpendicular to the second plate (168) (e.g., parallel to the first plate (166)). A clip (172) is shown associated with the back side of the first plate (166) for securing the holder (164) to an article of clothing or other object.

The depicted embodiment includes a barrier (174) (e.g., a latch, strap, plate, or similar member) extending from the first plate (166) such that the barrier (174) can at least partially block a vertical path of the firearm (176) that would disengage the firearm (176) from the holder (164). The barrier (174) can be moved into and from the vertical path of the firearm (176) by bending, flexing, and/or pivoting the body of the holder (164). For example, FIG. 11B depicts the first plate (166) having a pivot point therein, which permits movement of the first plate (166) between the position depicted in FIG. 11A and that depicted in FIG. 11B, such that the barrier (174) is movable in the direction indicated by the arrow (178) to remove the barrier (174) from the vertical path of the firearm (176).

Thus, in use, a firearm (176) can be engaged with the holder by removing the barrier (174) from the vertical path thereof, such that the insertable member (170) can be inserted within the barrel of the firearm (176), then returning the barrier (174) to the position shown in FIG. 11A. While the generally perpendicular angles between the plates (166, 168) and insertable member (170) may not generate significant friction between the firearm (176) and holder (164), the presence of the barrier (174) can prevent unintended movement of the firearm (176) upward along the insertable member (170), thereby maintaining the firearm (176) in engagement with the holder (164). When it is desired to disengage the firearm (176) from the holder (164), the barrier (174) can be moved toward the position shown in FIG. 11B, thereby allowing upward movement of the firearm (176) along the insertable member (170).

It should be understood that while FIGS. 11A and 11B depict a pivot point in the first plate (166), this configuration is an exemplary embodiment, and various methods could be used to enable the barrier (174) to be movable into and from the vertical path of the firearm (176). For example, a pivot point could exist at the intersection between the first and second plates (166, 168), along the second plate (168), at the intersection between the second plate (168) and the insertable member (170), along the insertable member (170), and/or the barrier (174) itself could be pivotable (e.g., upward), rotatable (e.g., about the longitudinal axis of the first plate (166), and/or retractable (e.g., spring biased). In other embodiments, at least a portion of the holder (164) could be formed from a generally flexible material, such that use of pivot points is unnecessary, and a portion of the holder (164) can simply be bent and/or flexed via a manual force to remove the barrier (174) from the vertical path of the firearm (176), while the tendency of the holder (164) to return to its original shape can maintain the barrier (174) in the position shown in FIG. 11A absent an external force applied by a user. In still other embodiments, the act of wearing the holder (164) (e.g., securing the holder (164) to a belt or other article of clothing), such that the holder (164) contacts a user and/or an adjacent surface, can serve to maintain the barrier (174) in the position shown in FIG. 11A due to the adjacent surface preventing undesired bending of the holder (164) that could otherwise remove the barrier (174) from the vertical path of the firearm (176).

While FIGS. 11A and 11B depict an embodiment of a holder (164) having plates (166, 168) and an insertable member (170) that are generally perpendicular to one another, it should be understood that in various embodiments, the components of the holder (164) could be configured such that the insertable member (170) extends toward the first plate (166) to generate friction between the firearm (176) and the holder (164), similar, for example, to the embodiment shown in FIG. 1.

Figure 12C:
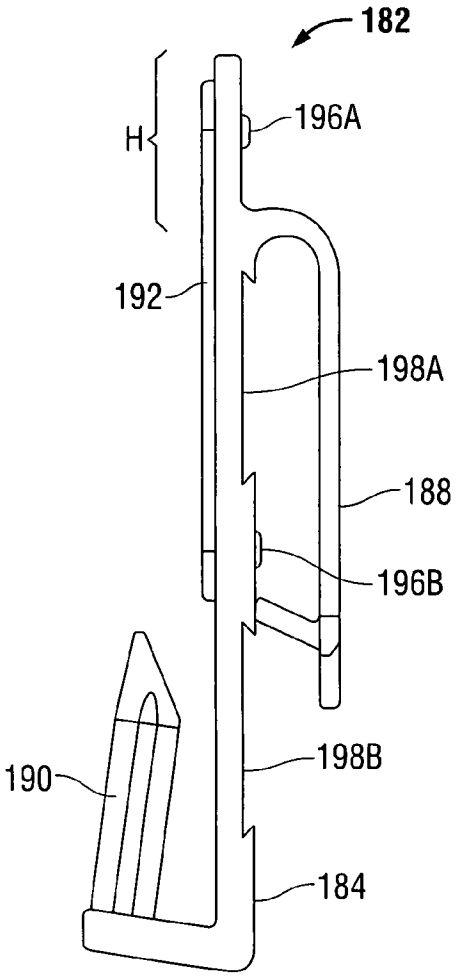
FIG. 12C depicts a side view of the holder of FIG. 12A.
Figure 12B:
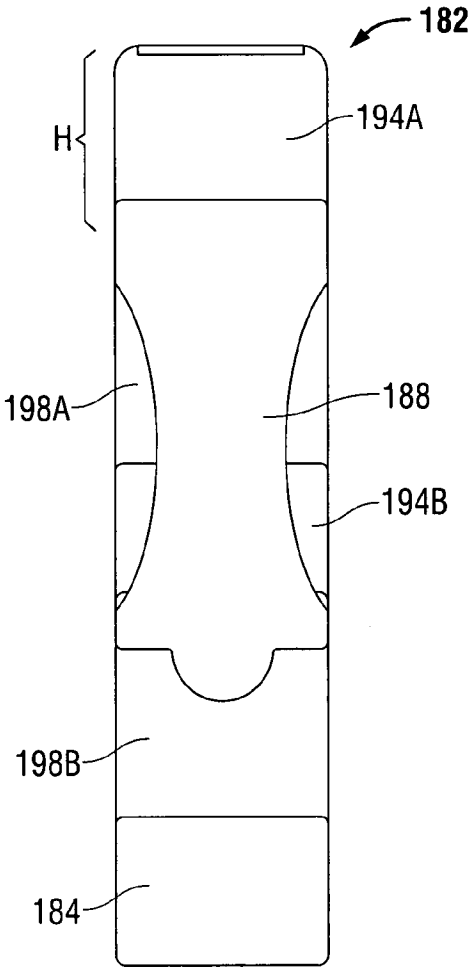
FIG. 12B depicts a rear view of the holder of FIG. 12A.
Figure 12A:
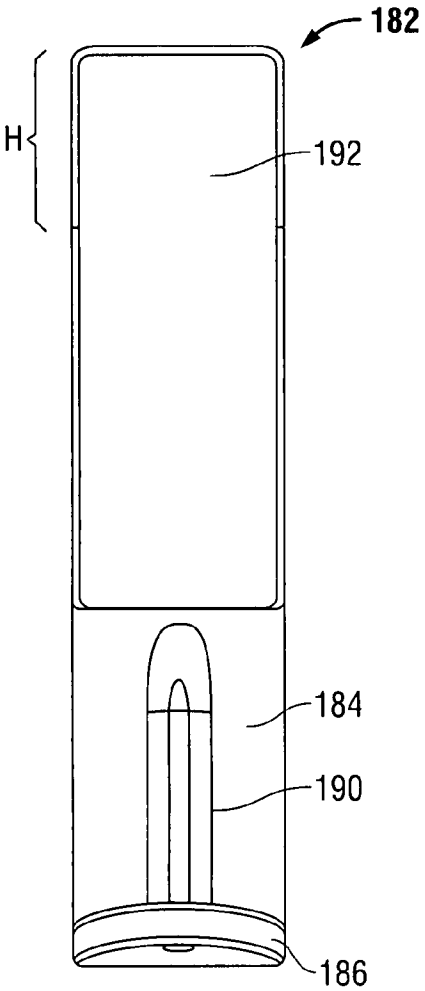
FIG. 12A depicts a front view of an embodiment of a holder for a firearm, usable within the scope of the present disclosure.

Referring now to FIGS. 12A, 12B, and 12C, an embodiment of a holder (182) for a firearm, usable within the scope of the present disclosure, is depicted. Specifically, FIG. 12A shows a front view of the holder (182), FIG. 12B shows a rear view of the holder (182), and FIG. 12C shows a side view thereof. The depicted embodiment includes a first plate (184) (e.g., a generally vertical plate) having a second plate (186) (e.g., a generally horizontal plate) extending therefrom at an angle. While FIGS. 12A through 12C depict the second plate (186) extending from the first plate (184) at an acute angle, (e.g., for urging a firearm against the first plate (184) to create friction between the firearm and the holder (182), as described above with regard to other embodiments), in other embodiments, the second plate (186) could extend from the first plate (184) at a right angle or an obtuse angle, and friction could be created between a firearm and the holder (182) through other means.

A clip (188) is shown extending from the first plate (184), for attaching the holder (182) to an article of clothing or an adjacent object, and an insertable member (190), shown as a pin and/or rod having a tapered and/or angled end is shown extending from the second plate (186) for engagement with a firearm (e.g., by inserting the insertable member (190) into the barrel thereof). The depicted embodiment is also shown including spaces (198A, 198B) formed in the rear side of the first plate (184), e.g., for engagement with spacing inserts, trigger guard inserts, or other accessories, similar to the embodiment shown in FIG. 1, though it should be understood that the spaces (198A, 198B) could be omitted without departing from the scope of the present disclosure.

The depicted holder (182) includes overmolding (192) placed over a portion of the front side of the first plate (184). The overmolding (192) also includes rear portions (194A, 194B) that overlap the back side of the first plate (184), which can facilitate securing the overmolding (192) to the holder (182), e.g., using pins (196A, 196B), rivets, or similar fasteners, or adhesives. In other embodiments, the overmolding (192) could be integrally connected to the body of the holder (182).

In addition to adding durability to the holder (182) and protecting portions thereof, the overmolding (192) can include a generally compressible and/or frictional material (e.g., rubber, plastic, one or more polymers, one or more composites, etc.) adapted to contact a firearm engaged with the holder (182) and generate friction therebetween. For example, a firearm engaged with the holder (182), e.g., via insertion of the insertable member (190) into the barrel thereof, can compress the overmolding (192) extending from the front side of the first plate (184), such that the tendency of the overmolding (192) to return to its original shape applies an outward force against the firearm, while the insertable member (190) prevents lateral movement thereof (e.g., effectively "clamping" the firearm between the insertable member (190) and the overmolding (192)). Alternatively or additionally, the overmolding (192) could include a frictional material that can contact the exterior of a firearm and generate friction therebetween to resist movement thereof, independent of whether the overmolding (192) is compressed by contact with the firearm. In the depicted embodiment, to enhance the frictional effect of the overmolding (192), e.g., by increasing the contact area between the overmolding (192) and a firearm, the first plate (184) can be provided with an extended height (H), over which the overmolding (192) can be placed. For example, the material of the overmolding (192) can be adapted to engage serrations along the slide of a firearm, effectively extending into the spaces between such serrations to resist vertical movement of the firearm. Additionally, use of overmolding can prevent damage and/or scratches to the finish and/or external surfaces of the holder and/or the firearm.

While FIGS. 12A through 12C depict an acute angle between the first plate (184) and the second plate (186), in various embodiments, friction between an engaged firearm and the overmolding (192) can be sufficient to limit unintended movement of the firearm relative to the holder (182), even in the absence of an insertable member that extends toward the first plate (184). For example, a holder having right or obtuse angles between the first and second plates (184, 186) and/or between the second plate (186) and the insertable member (190) could retain a firearm in engagement therewith solely through frictional contact between the firearm and the overmolding (192).

Figure 13A:
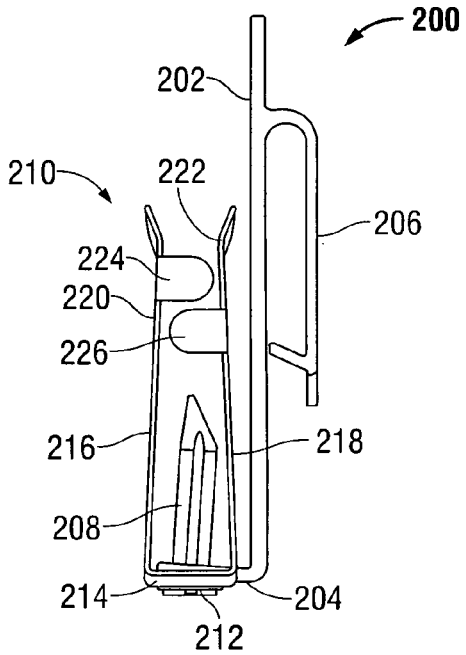
FIG. 13A depicts a side view of an embodiment of a holder for a firearm, usable within the scope of the present disclosure.
Figure 13B:
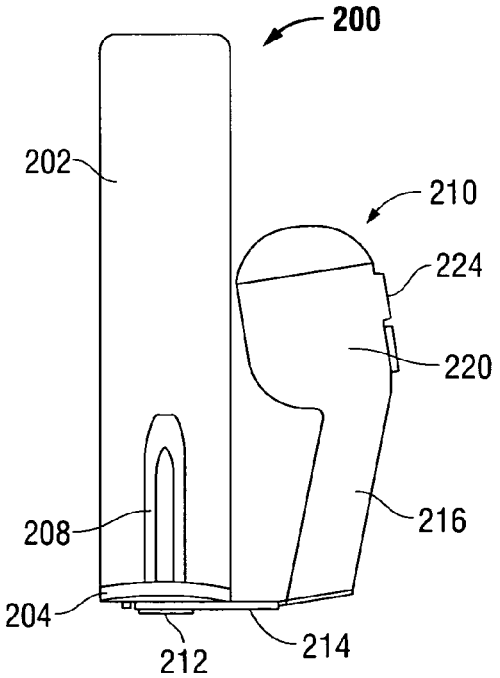
FIG. 13B depicts a front view of the holder of FIG. 13A.
Figure 13C:
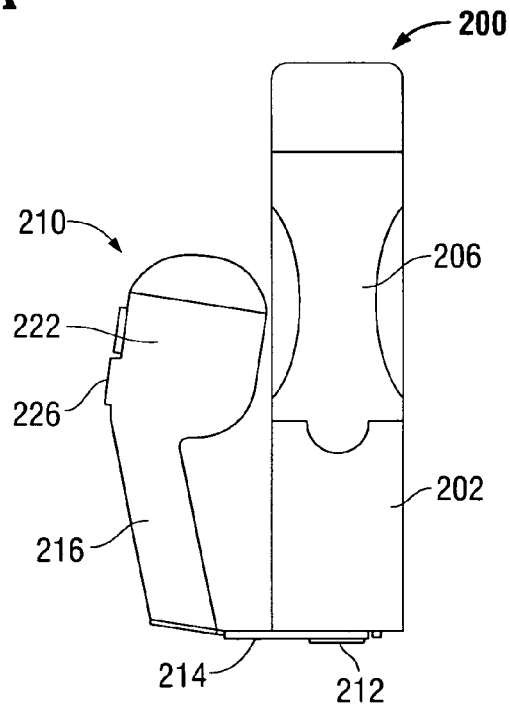
FIG. 13C depicts a rear view of the holder of FIG. 13A.
Figure 13E:
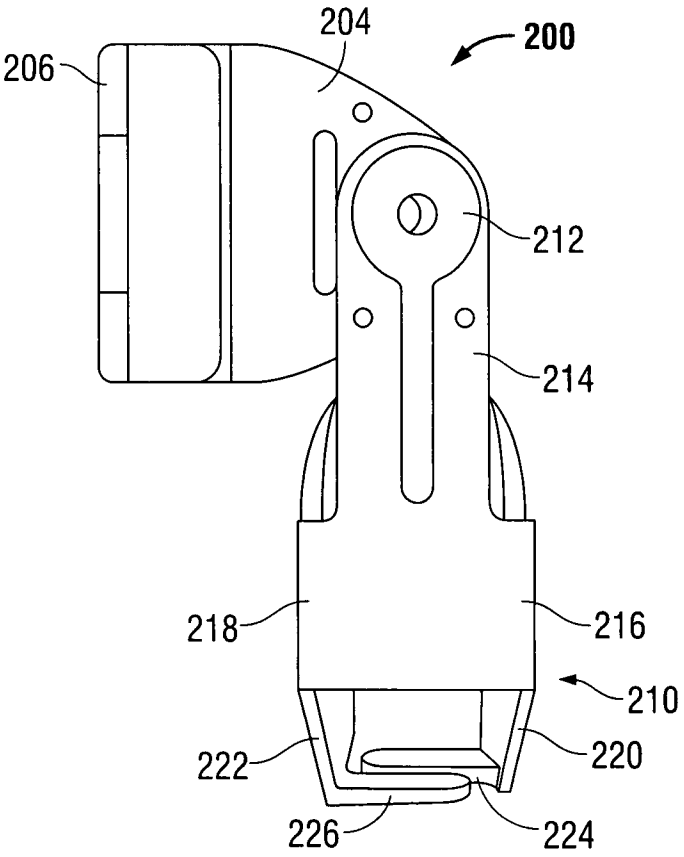
FIG. 13E depicts a bottom view of the holder of FIG. 13A.
Figure 13D:
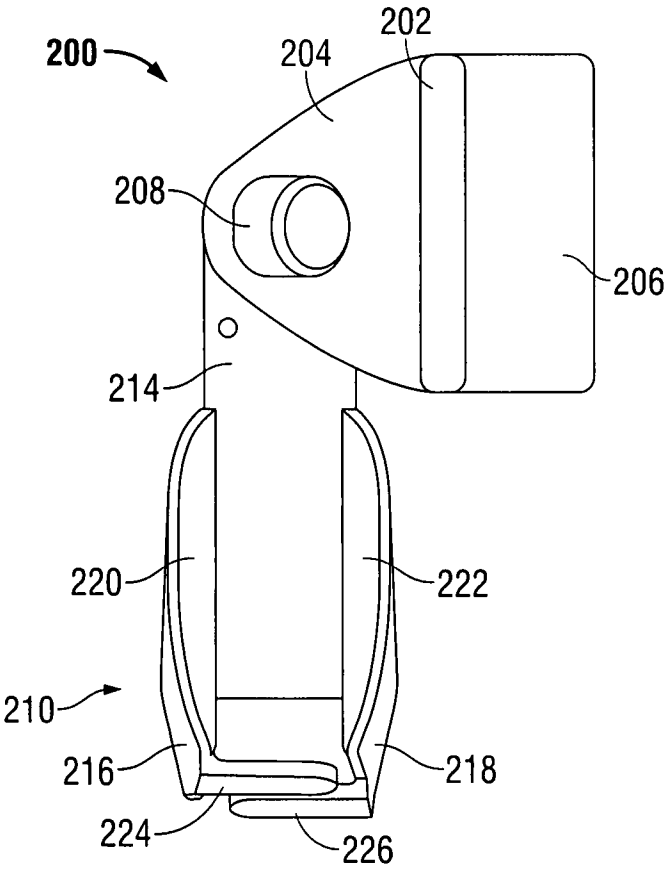
FIG. 13D depicts a top view of the holder of FIG. 13A.

Referring now to FIGS. 13A through 13E, an embodiment of a holder (200) is shown, having a trigger guard (210) in association therewith. Specifically, FIG. 13A depicts a side view of the holder (200), FIG. 13B depicts a front view, FIG. 13C depicts a rear view, FIG. 13D depicts a top view, and FIG. 13E depicts a bottom view thereof. The depicted embodiment includes a first plate (202) (e.g., a generally vertical plate) with a second plate (204) (e.g., a generally horizontal plate) extending from a lower end thereof at an angle (e.g., an acute angle). A clip (206) extends from the rear face of the vertical plate (202). While FIGS. 13A through 13E depict the second plate (204) extending from the first plate (202) at an acute angle, (e.g., for urging a firearm against the first plate (202) to create friction between the firearm and the holder (200), as described above with regard to other embodiments), in other embodiments, the second plate (204) could extend from the first plate (202) at a right angle or an obtuse angle, and friction could be created between a firearm and the holder (200) through other means.

A clip (206) is shown extending from the rear face of the first plate (202), for attaching the holder (200) to an article of clothing or an adjacent object, and an insertable member (208), shown as a pin and/or rod having a tapered and/or angled end is shown extending from the second plate (204) for engagement with a firearm (e.g., by inserting the insertable member (208) into the barrel thereof). The first plate (202) is shown having an extended height, similar to that shown in the embodiment depicted in FIGS. 12A through 12C.

The depicted holder (200) is further shown having a trigger guard (210) associated therewith, which can be attached, e.g., using a movable, rotatable, and/or pivotable connection, similar to that shown in FIGS. 8A through 8D and 9A through 9D, and/or using a fixed connection. In other embodiments, the trigger guard (210) could be integral with any portion of the holder (200). The trigger guard (210) is shown rotatably attached to the second plate (204) at a connection point (212) approximately underneath the insertable member (208), though other points of connection and/or other movable or fixed means of connection can be used without departing from the scope of the present disclosure. A generally horizontal bridge member (214) extends outward from the connection point (212), and serves to connect a first arm (216) (e.g., a left arm) and a second arm (218) (e.g., a right arm) to the holder (200). The arms (216, 218) are shown extending generally upward from the bridge member (214), terminating in a first face (220) and a second face (222), respectively. The faces (220, 222), arms (216, 218), and bridge member (214) can be sized and positioned such that when a firearm is engaged with the holder (200) (e.g., through insertion of the insertable member (208) into the barrel thereof), the trigger portion of the firearm is positioned between the first and second faces (220, 222).

Each face (220, 222) is show having a contacting member (224, 226) extending therefrom, generally perpendicular thereto. The contacting members (224, 226) extend across the space between the faces (220, 222), such that contact between the contact members (220, 222) and the trigger portion of a firearm can move and/or bias the trigger guard (210) outward, such that the faces (220, 222) remain generally aligned with the trigger portion of the firearm, independent of the external features or configuration of the firearm. Contact between the contacting members (224, 226) and the firearm can also facilitate the application of a force from the trigger guard (210) to the firearm. For example, the outward movement of the trigger guard (210) caused by contact between the firearm and the contacting members (224, 226) can slightly bend, flex, and/or otherwise move the bridge member (214) and/or the arms (216, 218), such that the tendency of the trigger guard (210) to return to its original position applies a counter-force against the firearm.

As such, in use, when a firearm is engaged with the holder (200) (e.g., by inserting the insertable member (208) into the barrel thereof), the firearm can be oriented such that the trigger portion thereof is positioned between the first and second faces (220, 222) of the trigger guard (210), while the trigger portion thereof contacts the contacting members (224, 226). Contact between the firearm and the contacting members (224, 226) can urge the trigger guard (210) outward, such that the faces (220, 222) remain in an overlapping relationship with the trigger portion of the firearm. Further, such outward movement of the trigger guard (210) can cause the trigger guard (210) to apply a counter-force against the firearm that urges the firearm against one or more portions of the holder (200). For example, when the trigger guard (210) is positioned as depicted in FIGS. 13A through 13E (e.g., generally perpendicular to the first and second plates (202, 204)), the force applied to a firearm by the trigger guard (210) would urge the firearm against the insertable member (208), increasing frictional contact therebetween. As described above, the trigger guard (210) can be positioned in other orientations, such that the force applied to a firearm by the trigger guard (210) would urge the firearm against the first and/or second plates (202, 204). In an embodiment, the first and second faces (220, 222) can be spaced such that placement of the firearm therebetween may contact one or both faces (220, 222) (e.g., via a force-fit of friction fit between the faces (220, 222)), such that insertion of a firearm therebetween can urge one or both faces in an outward direction. The tendency of the trigger guard (210) to return to its original shape can cause the faces (220, 222) to frictionally grip and/or clamp the firearm, thereby preventing unintended movement of the firearm relative to the holder (200).

Figure 13F:
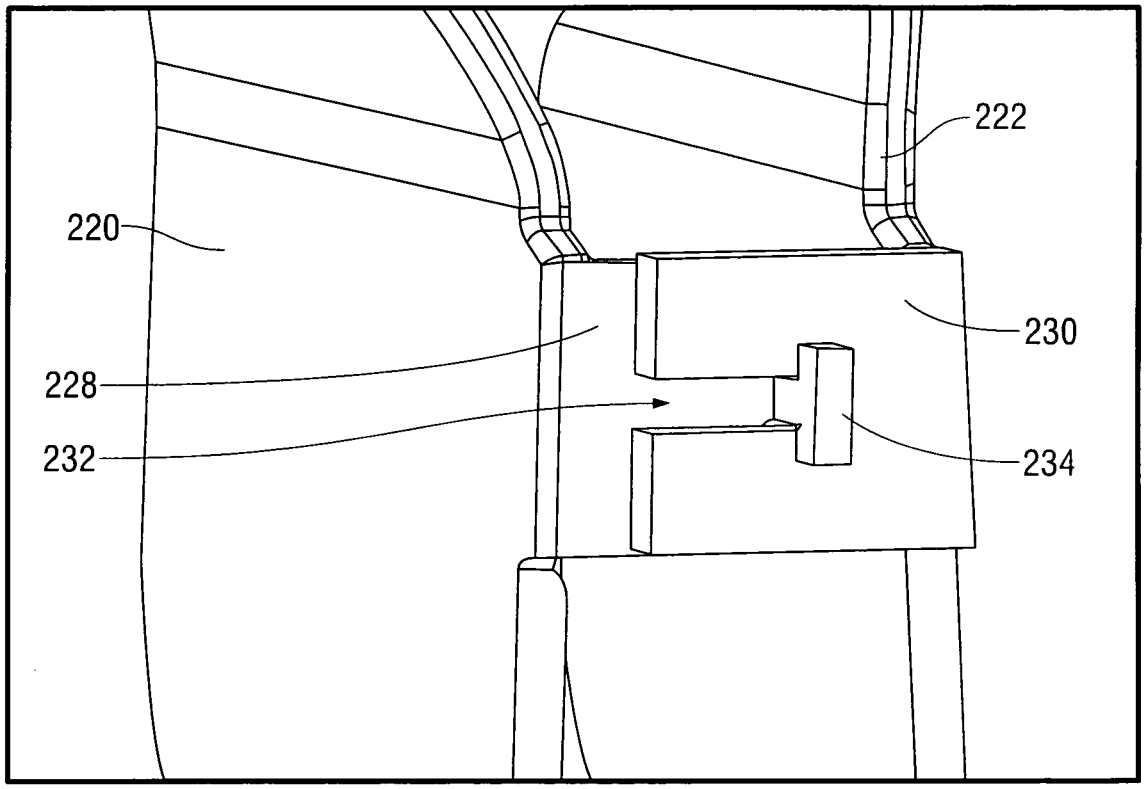
FIG. 13F depicts a side perspective view of an alternate embodiment of contacting members usable with the holder of FIG. 13A.

FIG. 13F depicts a side perspective view, illustrating an alternate configuration of contacting members. Specifically, while FIG. 13A depicts first contacting member (224) extending from the first face (220) in a position above the second contacting member (226) extending from the second face (222), FIG. 13F depicts a configuration in which first and second contacting members (228, 230), extending from the first and second faces (220, 222), respectively, are in generally the same horizontal plane, such that the contacting members (228, 230) are positioned in an overlapping relationship. Additionally, a slot (232) is shown in the second contacting member (230), which receives a pin or similar protrusion (234) extending from the first contacting member (228), such that movement of the first and second contacting members (228, 230) relative to one another is limited by contact between the protrusion (234) and slot (232). It should be understood that while FIG. 13F depicts a slot (232) in the second contacting member (230) and a protrusion (234) in the first contacting member (228), any number of protrusions could extend from either contacting member (228, 230) for engagement within any number of complementary features within the other contacting member. In an embodiment, a stop can be included in the slot (232), on the protrusion (234), and/or on either contacting member (228, 230) to prevent removal of the protrusion (234) from the slot (232) and disengagement of the contacting members (228, 230) from one another. The depicted configuration can provide additional resilience to the trigger guard, e.g., when contacted by a firearm, and can prevent any misalignment of the faces (220, 222). Further, use of a stop or similar feature can prevent excessive or undesired extension of the faces (220, 222) in a direction apart from one another.

As such, embodiments described herein relate to holders for firearms, and related methods, usable as "universal" holders, able to secure multiple types of firearms in a variety of orientations. While generally, embodiments of holders usable within the scope of the present disclosure can include a member for insertion into the barrel of a firearm, angled to urge the firearm into contact with the body of the holder to create friction therebetween, other embodiments can use compressible and/or frictional surfaces to create this friction, and/or can include a holder formed at least partially from a flexible material that is moved into contact with an engaged firearm when worn by a user. Further embodiments can include trigger guards and/or other accessories that frictionally contact a firearm, and/or urge the firearm into frictional contact with the body of the holder. Still other embodiments can include a barrier (e.g., a latch, strap, plate, etc.) that impedes the vertical path of the firearm to prevent unintended removal thereof from the holder. Embodiments usable within the scope of the present disclosure thereby enable a holder, having a minimum of bulk, to be used to secure a firearm, independent of the external features of the firearm.

While various embodiments usable within the scope of the present disclosure have been described with emphasis, it should be understood that within the scope of the appended claims, the present invention can be practiced other than as specifically described herein.

What is claimed is:

1. A holder for a firearm having a trigger portion, the holder comprising:

a first plate having a front face, a rear face, and an edge;

a second plate extending from the first plate at a first angle;

an insertable member extending from the second plate at a second angle; and a trigger guard having a first member extending from the edge of the first plate, a second member opposite the first member, and a connecting member extending between the first member and the second member, wherein the first member and the second member define a space therebetween, the space adapted to receive the trigger portion of the firearm wherein an angle between the second member and the connecting member of the trigger guard is less than ninety degrees such that the second member extends towards the first member.

2. The holder of claim 1, wherein first plate includes at least one space formed in a rear face thereof and the trigger guard includes at least one insertion portion positioned in the at least one space.

3. The holder of claim 2 wherein said at least one space comprises a protrusion, a receptacle, or combinations thereof adapted for engagement with a complementary receptacle, a complementary protrusion, or combinations thereof formed in the at least one insertion portion of the trigger guard.

4. The holder of claim 2, wherein the at least one insertion portion is selectively insertable into a first side of said at least one space or a second side of said at least one space.

5. The holder of claim 1, wherein the first plate comprises at least one space formed therein, and wherein at least one portion of the trigger guard occupies said at least one space.

6. The holder of claim 5, wherein said at least one space includes a generally trapezoidal cross-sectional shape.

7. The holder of claim 1, wherein the trigger guard includes a tapered portion extending between the first member of the trigger guard and the edge of the first plate, the tapered portion having a width at the first plate greater than a width at the first member.

8. The holder of claim 1, wherein the second plate extends from the front face of the first plate and a portion of the first member of the trigger guard is spaced apart from the front face in a direction toward the second plate.

9. The holder of claim 1, wherein the insertable member includes an elongate body and a tapered tip, the tapered tip including a first side facing the first plate and a second side opposite the first side, and wherein an angle between the first side and the elongate body is greater than an angle between the second side and the elongate body.

10. The holder of claim 1, wherein the first angle, the second angle, or combinations thereof comprises an acute angle, such that the insertable member extends toward the first plate.

11. The holder of claim 1, wherein the first plate comprises a protrusion extending from a front side thereof, and wherein the protrusion is adapted to frictionally contact the firearm to stabilize the firearm against vertical movement.

12. The holder of claim 1, wherein the first plate comprises a barrier extending from a front side thereof, and wherein the barrier is movable between a first position that extends at least partially above the second plate for impeding a vertical path of the firearm, and a second position in which the vertical path is substantially unimpeded.

13. The holder of claim 1, wherein the first plate, the second plate, the insertable member, or combinations thereof are at least partially formed from a flexible material.

14. The holder of claim 1, wherein the first member comprises a tapered member connecting the first plate to the first member of the trigger guard, the tapered member extending from the first plate in the direction of the second plate.

15. A holder for a firearm, the holder comprising:

a first plate having a front side, a rear side, and at least one space formed in the rear side;

a second plate extending from the front side of the first plate at a first angle;

an insertable member extending from the second plate at a second angle; and a trigger guard engaged with the first plate and comprising at least one insertion portion occupying the at least one space and a trigger cover portion extending from the first plate, wherein the first angle, the second angle, or combinations thereof comprises an acute angle.

16. The holder of claim 15, wherein the trigger guard includes a first member extending from the first plate, a second member opposite the first member, and a connecting member extending between the first member and the second member.

17. The holder of claim 16, wherein a portion of the first member of the trigger guard is spaced apart from the front side of the first plate in a direction toward the second plate.

18. The holder of claim 15, wherein the trigger guard comprises a semi-circular shape.

19. The holder of claim 15, wherein the first member and the second member of the trigger guard are non-parallel such that the second member extends from the connecting member toward the first member.

20. The holder of claim 15, wherein the first plate further includes an edge between the front side and the rear side, the trigger guard extending outward from the edge.

21. A holder configured for retaining a firearm, the holder comprising:

a first plate having a front face, a first side edge, a second side edge, and a rear face, the rear face including one or more recessions formed therein;

a second plate extending from the front face of the first plate at a first angle less than or equal to ninety degrees, the second plate having a top face and a bottom face;

an insertable member extending from the top face of the second plate toward the front face of the first plate at a second angle less than or equal to ninety degrees; and a trigger guard insert having a body and one or more insertion portions positioned within the one or more recessions of the first plate to retain the trigger guard insert in association with the first plate, the body of the trigger guard insert extending from one of the first side edge or the second side edge of the first plate, wherein one or more of the first plate, the second plate, or the insertable member is movable to modify a position of the insertable member relative to the first plate for accommodating placement of the insertable member within the firearm.

22. The holder of claim 21, wherein the one or more recessions have a width equal to a width of the first plate.

23. The holder of claim 22, wherein the one or more insertion portions of the trigger guard insert are configured for selective insertion into the one or more spaces from the first side edge or the second side edge of the first plate to selectively position the body of the trigger guard insert relative to the first side edge or the second side edge.

24. The holder of claim 21, wherein the body of the trigger guard insert includes a rear face, a front face opposite the rear face, and a connecting face engaging the rear face to the front face.

25. The holder of claim 24, wherein the rear face is generally perpendicular to the connecting face and an angle between the front face and the connecting face is less than ninety degrees such that the front face and the rear face are non-parallel.

26. The holder of claim 21, wherein the insertable member includes a generally cylindrical body and a tapered tip, the tapered tip including a first side facing the first plate and a second side opposite the first side, and wherein an angle between the first side and the generally cylindrical body is greater than an angle between the second side and the generally cylindrical body.

27. The holder of claim 21, wherein the one or more recessions includes a generally trapezoidal cross-sectional shape.

* * * * *